US006883352B2

(12) United States Patent
Miyai

(10) Patent No.: US 6,883,352 B2
(45) Date of Patent: Apr. 26, 2005

(54) LOOP PRESSER, FLATBED KNITTING MACHINE HAVING LOOP PRESSER, AND FABRIC KNITTING METHOD USING LOOP PRESSER

(75) Inventor: Takuya Miyai, Wakayama (JP)

(73) Assignee: Shima Seiki Manufacturing Limited, Wakayama (JP)

( * ) Notice: Subject to any disclaimer, the term of this patent is extended or adjusted under 35 U.S.C. 154(b) by 0 days.

(21) Appl. No.: 10/487,591

(22) PCT Filed: Aug. 22, 2002

(86) PCT No.: PCT/JP02/08454

§ 371 (c)(1),
(2), (4) Date: Feb. 24, 2004

(87) PCT Pub. No.: WO03/018892

PCT Pub. Date: Mar. 6, 2003

(65) Prior Publication Data

US 2004/0221621 A1 Nov. 11, 2004

(30) Foreign Application Priority Data

Aug. 24, 2001 (JP) ..... 2001-255148

(51) Int. Cl.[7] ..... D04B 15/02
(52) U.S. Cl. ..... 66/95; 66/64
(58) Field of Search ..... 66/95, 96 R, 96 W, 66/97, 64, 60 R, 147

(56) References Cited

U.S. PATENT DOCUMENTS 3,842,623 A * 10/1974 Flavell et al. ..... 66/64
3,973,416 A * 8/1976 Kohler ..... 66/64
4,027,504 A * 6/1977 Dietschy et al. ..... 66/64
4,083,203 A * 4/1978 Theys ..... 66/64
4,433,560 A * 2/1984 Betts ..... 66/64
4,501,132 A * 2/1985 Flavell et al. ..... 66/64
5,134,864 A 8/1992 Yabuta et al.
5,884,505 A 3/1999 Shima
5,992,183 A 11/1999 Shima
6,119,486 A * 9/2000 Morita et al. ..... 66/60 R

FOREIGN PATENT DOCUMENTS

| | | |
|---|---|---|
| JP | 5-47654 | 7/1993 |
| JP | 3013272 | 12/1999 |
| JP | 3044373 | 3/2000 |
| JP | 3085657 | 7/2000 |

* cited by examiner

*Primary Examiner*—Danny Worrell
(74) *Attorney, Agent, or Firm*—Wenderoth, Lind & Ponack, L.L.P.

(57) ABSTRACT

An object of the invention is to improve yarn feeding conditions to a knitting needle and improve a loop pressing function and a yarn holding function for end stitches in a flat knitting machine provided with a compound needle. In a top portion 12 of a loop presser 11 advancing to a tooth mouth 10, a knitting yarn holding portion for end stitches 13 and a loop presser portion 14 are formed. The knitting yarn holding portion for end stitches 13 hides a tongue 25*a* from the yarn 22 at a wall portion 15 above the knitting yarn holding portion for end stitches 13 so that the problem of yarn entanglement that the yarn 22 fed to a hook 24*a* of the compound needle 23 from a yarn feeding port 20 is surmounted on the tongue 25*a* may be solved. A pressing portion 16 below the knitting yarn holding portion for end stitches 13 presses the yarn 22. The knitting yarn holding portion for end stitches 13 holds the yarn 22 outside the end stitch by winding it around it. The loop presser portion 14 presses the yarn 22 during the knitting. While hiding the tongue 25*a* of the needle 23 of the end stitch at the wall portion 15, the yarn 22 can be guided into the hook 24*a* reliably by causing the loop presser portion 14 of another loop presser 11 to act.

15 Claims, 13 Drawing Sheets

(a)

(b)

LOOP PRESSER, FLATBED KNITTING MACHINE HAVING LOOP PRESSER, AND FABRIC KNITTING METHOD USING LOOP PRESSER

TECHNICAL FIELD

The present invention relates to a loop presser that presses a knitting stitch loop during knitting with a flat knitting machine, a flat knitting machine provided with the loop presser and a method for making a knitted fabric using the loop presser.

BACKGROUND ART

Conventionally in a flat knitting machine, a latch needle 1 as shown in FIG. 15 is used as a basic knitting needle. The latch needle 1 has a hook 1*a* at the top, and a knitting operation is performed in which a knitting stitch loop is formed while opening or closing the hook 1*a* by swinging and displacing the latch 1*b* with a rivet 1*c* as its center.

FIG. 15(1) shows a state in which after a ready-made knitting stitch loop 2A is formed with a knitting yarn, the latch needle 1 is lifted so that the latch 1*b* is opened by the knitting stitch loop 2A from an inner side of the hook 1*a*. FIG. 15(2) shows a state in which the latch needle 1 is lifted to the uppermost position, and an old knitting stitch loop 2A is moved so as to be positioned lower than the latch 1*b*, and then the latch needle 1 starts to come down, and a knitting yarn is supplied to the hook 1*a* to form a new knitting stitch loop 2B. FIG. 15(3) shows a state in which the latch needle 1 has come down, and the latch 1*b* is closed by the knitting stitch loop 2A when the latch 1*b* has passed through the portion of the old knitting stitch loop 2A. FIG. 15(4) shows a state in which the latch needle 1 reaches the lowermost position, and the old knitting stitch loop 2A passes from the closed latch 1*b* to the outside of the hook 1*a* and a knockover is generated, and thus a new knitting stitch loop 2B is formed.

In the basic knitting with the latch needle 1, the operations (1) to (4) are repeated. Therefore, it is necessary to move the latch needle upward and downward by a stroke S1 between the uppermost position where the hook 1*a* is higher than the state shown in (2) and the lowermost position shown in (4). The top of the latch 1*b* draws a locus 1*d* shown in FIG. 15(2), so that when a knitting yarn is supplied inside the locus 1*d*, a knitting stitch loop can be formed between the hook 1*a* and the latch 1*b* when the latch 1*b* is closed as shown in FIG. 15(3).

In a flat knitting machine, a compound needle 3 as shown in FIG. 16 is used as well. The compound needle 3 serves as a knitting needle, using a needle main body 4 and a slider 5. A hook 4*a* is formed on the top of the needle main body 4, and a tongue 5*a* is formed on the top of the slider. The needle main body 4 and the slider 5 can move independently in the vertical direction of the drawing, and the relative movement of the slider 5 with respect to the needle main body 4 can open and close the hook 4*a* with the tongue 5*a*. The configuration of the flat knitting machine using such a compound needle 3 is disclosed in Japanese Patent No. 3085657 by the applicant.

FIG. 16(1) shows the state in which after a ready-made knitting stitch loop 2A is formed with a knitting yarn, the needle main body 4 is lifted, and the hook 4*a* is apart from the tongue 5*a* of the slider 5 so that the needle hook for holding the knitting stitch loop 2A is opened. FIG. 16(2) shows a state in which the needle main body 4 is lifted to the uppermost position, and an old knitting stitch loop 2A is moved so as to be positioned in the tongue 5*a*, and then the needle main body 4 starts to come down, and a knitting yarn is supplied to the hook 4*a* to form a new knitting stitch loop 2B. FIG. 16(3) shows a state in which the needle main body 4 has come down, the tongue 5*a* holds the old knitting stitch loop 2A and the needle hook is closed. FIG. 16(4) shows a state in which the needle main body 4 and the slider 5 reach the lowermost position, and the old knitting stitch loop 2A passes from the closed tongue 5*a* to the outside of the hook 4*a* and a knockover is generated, and thus a new knitting stitch loop 2B is formed.

In the case of a flat knitting machine having the compound needle 3, the movement of the slider 5 having the tongue 5*a* on its top that is apart from or in contact with the hook 4*a* to open or close the needle hook does not draw the locus 1*d* of arc movement such as the latch 1*b* of the latch needle 1, but draws a linear locus 3*a*. Therefore, an advance and retreat stroke S2 of the needle main body 4 can be small, so that the size of the flat knitting machine can be reduced and high productivity can be obtained.

In order to increase the productivity with the flat knitting machine, a loop presser that presses knitting stitch loops during knitting can be used. The applicant discloses the configuration of a flat knitting machine in which a loop presser is mounted in Japanese Patent No. 3044373. FIGS. 5 to 8 of this patent publication disclose the configuration in which a loop presser for pressing a knitting stitch loop latched by a latched needle and a yarn guide for pressing down a knitting yarn suspended from a yarn feeding port to the latch needle with a yarn pressing portion and guiding the knitting yarn to a position at which the hook of the latch needle can hold the knitting yarn are provided. FIGS. 13 and 14 disclose the configuration in which a loop pressing portion of the loop presser is advanced to a side end portion of a knitted fabric, and end stitches are made while the knitting yarn extending from the last formed knitting stitch loop to the yarn feeding port is pressed. Such a function can be regarded as a yarn guiding function for the end stitches. Furthermore, FIG. 15 and the following drawings disclose the configuration in which the yarn guiding function also is served by a loop presser as a "best mode example". In this best mode example, one loop presser presses a knitting stitch loop and feeds a yarn to the hook, and even in the case of the compound needle, stable yarn feeding conditions can be obtained.

As described above, in the compound needle 3, as shown in FIG. 16, the necessary stroke is smaller than in the latch needle 1 shown in FIG. 15, so that the productivity can be increased. However, opening/closing the hook 4*a* of the compound needle 3 is performed by the movement that draws the linear locus 3*a* as described above, and therefore the yarn feeding conditions are stricter than in the latch needle 1. When the best mode example disclosed in Japanese Patent No. 3044373 is used, it is expected that stable yarn feeding conditions can be obtained even for the compound needle.

The yarn guiding function for end stitches disclosed in Japanese Patent No. 3044373 is performed using the same portion of the top portion of the loop presser as used for the loop pressing function. It is not particularly considered to make a portion exclusively for the yarn guiding function for end stitches. The carriage that controls the knitting movement of the knitting needle is provided with a plurality of sets of systems constituted by cam locks, and when the carriage travels once in a longitudinal direction of a knitting bed, a plurality of courses can be knitted. It is selected in one needle selecting portion provided corresponding to each system for knitting whether or not the loop presser is to be operated, and the cam route in which the loop presser passes is controlled by a solenoid, so that switching whether only the loop pressing function is operated or the loop pressing function and the yarn guiding function are operated is performed. For this reason, the loop presser used during knitting one course passes always in the same cam route.

In a case where a knitted fabric is knitted with the compound needle, the following problem may be caused. In the side end portion of the knitted fabric that becomes a folded portion of the knitted fabric, the knitting yarn is surmounted on the slider of the knitting needle when feeding the yarn to the knitting needle for the start of knitting for the next course, and this knitting yarn cannot be held by the needle hook (hereinafter, this problem is referred to as "yarn entanglement"). The problem of yarn entanglement in end stitches may be caused by the following factors.

The position of the knitting yarn at the time of feeding the yarn is not precisely determined partly because the position of the yarn feeding port provided on the top of the yarn carrier is not appropriately adjusted, or the yarn carrier does not work due to a long time use. In a case where so-called multiple yarn knitting using bundled knitting yarns is performed, the knitting yarn is particularly easily surmounted on the slider, because the knitting yarn is flattened and extended at the point when the knitting yarn is in contact with the knitting needle. Furthermore, when the tension applied to the knitting yarn is weak, the knitting yarn is easily dislocated and easily surmounted on the slider. The problem is caused especially when the knitting needle for knitting at the end of the course is the same needle that for knitting at the start of the next course such as plain stitch or rib stitch.

SUMMARY OF THE INVENTION

It is an object of the invention to provide a loop presser that can improve the yarn feeding conditions to a knitting needle and improve the loop pressing function and the yarn guiding function to end stitches in a flat knitting machine provided with a compound needle including a needle main body and a slider as a knitting needle, a flat knitting machine provided with the loop presser and a method for making a knitted fabric using the loop presser.

It is another object of the invention to provide a loop presser that can prevent the problem of yarn entanglement in which a knitting yarn is surmounted on the slider with a knitting needle for end stitches and can guide the knitting yarn into the needle hook when a compound needle is used by switching with needle selection patterns or the like, a flat knitting machine provided with the loop presser and a method for making a knitted fabric using the loop presser.

The invention provides a loop presser in a flat knitting machine comprising at least a pair of needle beds in the front and the back in which a tooth mouth is formed such that the front and back needle beds are opposed to each other in a form of an angle such that top sides are oriented upward. A compound needle is provided in each needle bed as a knitting needle, in a process of making a knitting yarn fed from a yarn feeding port traveling in a longitudinal direction of the needle bed above the tooth mouth into a knitting stitch loop to form a knitted fabric that is suspended downward, the loop presser being capable of advancing and retracting its top portion from an auxiliary bed supported on at least one of the front and back needle beds with respect to the tooth mouth and having a function of pressing the knitting stitch loop that is made. The top portion is in different positions in the advancing and retracting direction a loop presser portion having the function of guiding the knitting yarn fed from the yarn feeding port to the knitting needle and pressing the knitting stitch loop between the knitting needles on a lower side. A knitting yarn holding portion for end stitches serves a function of holding a knitting yarn fed from above the tooth mouth in the outside of a knitting end of a knitted fabric in a width direction. The knitting yarn holding portion has a pressing portion for pressing the knitting yarn suspended from the knitting stitch loop held by the compound needle in the knitting end to the yarn feeding port moving toward the outside of the knitted fabric on the lower side, and a wall portion preventing the knitting yarn fed from the yarn feeding port moving toward the inside of the knitted fabric by reversing the moving direction to the compound needle in the knitting end from approaching a tongue top in a state where a hook is open on an upper side.

The invention is characterized in that the knitting yarn holding portion is nearer on a top side of the advancing and retracting direction than the loop presser portion.

The invention is characterized in that the knitting yarn holding portion has a recess on which a knitting yarn made of multiple yarns that are formed with a bundle of a plurality of fine yarns are converged on its lower side.

Furthermore, the invention provides a flat knitting machine comprising the loop presser of any one of the above-described loop pressers. A loop presser mechanism advances to and retracts from the top portion according to a predetermined locus so as to guide the knitting yarn fed from the yarn feeding port passing through a position of the compound needle for making a knitted fabric to a position where the knitting yarn can be held by a hook of the compound needle and press a knitting stitch loop which is knitted by the pressing portion. A knitting yarn holding mechanism for end stitches makes the knitting yarn hold so as to advance the knitting yarn holding portion to the tooth mouth on the side before the compound needle used at first in knitting in knitting a knitted end, reversing a traveling direction of a yarn and starting knitting a next course, presses the knitting yarn suspended from the compound needle in which the knitting end is knitted to the yarn feeding port on the lower side of the knitting yarn holding portion of the loop presser until the yarn feeding port passes through a position of the compound needle, and feeds the knitting yarn to the compound needle used at first in knitting from the upper side of the the knitting yarn holding portion. After the yarn feeding port passes through the compound needle used at first in knitting, the loop presser mechanism and the knitting yarn holding mechanism cooperate so as to prevent the knitting yarn fed to the compound needle used at first in knitting by guide by the loop presser portion of the loop presser that is advanced to and retracted from by the loop presser mechanism is prevented, from approaching a tongue top in a state where a hook is open by the wall portion on the upper side of the knitting yarn holding portion of the loop presser that is advanced to and retracted from by the knitting yarn holding mechanism.

The invention is characterized in that the auxiliary bed in which the loop presser advances and retracts is open downward on a base end side of the advancing and retracting direction. The loop presser has a butt projected upward the flat knitting machines further comprises a selecting mechanism that is opposed to the base end portion of the loop presser below the open portion of the auxiliary bed and attracts the base end portion and can release the attraction selectively. A cam mechanism has a function as the loop presser mechanism or the knitting yarn holding mechanism selectively, in which a cam groove that is engaged with the butt above the auxiliary bed and drives the butt to be displaced in the advancing and retracting direction is formed. The cam mechanism can switch to the function either as the loop presser mechanism or the knitting yarn holding mechanism by selecting the cam groove engaged with the butt by releasing attraction to the base end portion of the loop presser with the selecting mechanism.

The invention is characterized in that the cam groove of the cam mechanism has generally a symmetrical shape with respect to a central line parallel to the advancing and retracting direction of the loop presser so that the top portion of the loop presser draws the same locus at the time of knitting on one side of the longitudinal direction of a needle bed as that at the time of knitting on the other side. The selecting mechanism is positioned in a position opposed to the central line of the cam mechanism and positions that are the same distance away from the position opposed to the central line on one side and the other side of the needle bed.

Furthermore, the invention provides a method for making a knitted fabric using a loop presser in a flat knitting machine comprising at least a pair of needle beds in the front and the back in which a tooth mouth is formed such that the front and the back needle beds are opposed to each other in a form of an angle such that top sides are oriented upward. A compound needle is provided in each needle bed as a knitting needle, in a process of making a knitting yarn fed from a yarn feeding port traveling in a longitudinal direction of the needle bed above the tooth mouth into a knitting stitch loop to form a knitted fabric that is suspended downward. The loop presser is capable of advancing and retracting its top portion from an auxiliary bed supported on at least one of the front and back needle beds with respect to the tooth mouth and has a function of pressing the knitting stitch loop that is made. The method comprises forming in the top portion of the loop presser in different positions in the advancing and retracting direction, a portion having the function of guiding the knitting yarn fed from the yarn feeding port to a position where the knitting yarn can be held by a hook of the compound needle and pressing the knitting stitch loop between the knitting needles on the lower side, and a portion serving a knitting yarn holding function for end stitches of holding a knitting yarn fed from above the tooth mouth in the outside of a knitting end of a knitted fabric in the width direction, switching the loop presser function or the knitting yarn holding function by switching the position to which the top portion of the loop presser is advanced to the tooth mouth, making the knitting yarn hold so as to advance the portion serving the knitting yarn holding function in the top portion of the loop presser to the tooth mouth on the side before the compound needle used at first in knitting in knitting a knitted end, reversing a traveling direction of a yarn and starting knitting a next course, pressing the knitting yarn suspended from the compound needle in which the knitting end is knitted to the yarn feeding port on the lower side of the portion serving the knitting yarn holding function until the yarn feeding port passes through a position of the compound need, and feeding the knitting yarn to the compound needle used at first in knitting from the upper side of the portion serving the the knitting yarn holding function, and after the yarn feeding port passes through the compound needle used at first in knitting, making the loop presser cooperate so as to advance another loop presser to the tooth mouth and prevent the knitting yarn fed to the compound needle used at first in knitting by guide by the portion serving the loop presser function, from approaching a tongue top in a state where a hook is open by an upper side of the loop presser that advances the portion serving the knitting yarn holding function to the tooth mouth serving as a wall.

The invention is characterized in that the portion serving the knitting yarn holding function has a recess on the lower side, and knitting is performed while converging a knitting yarn made of multiple yarns that are formed with a bundle of a plurality of fine yarns on the recess.

BRIEF DESCRIPTION OF THE DRAWINGS

Other and further objects, features, and advantages of the invention will be more explicit from the following detailed description taken with reference to the drawings wherein.

BEST MODE FOR CARRYING OUT THE INVENTION

Figure 1:
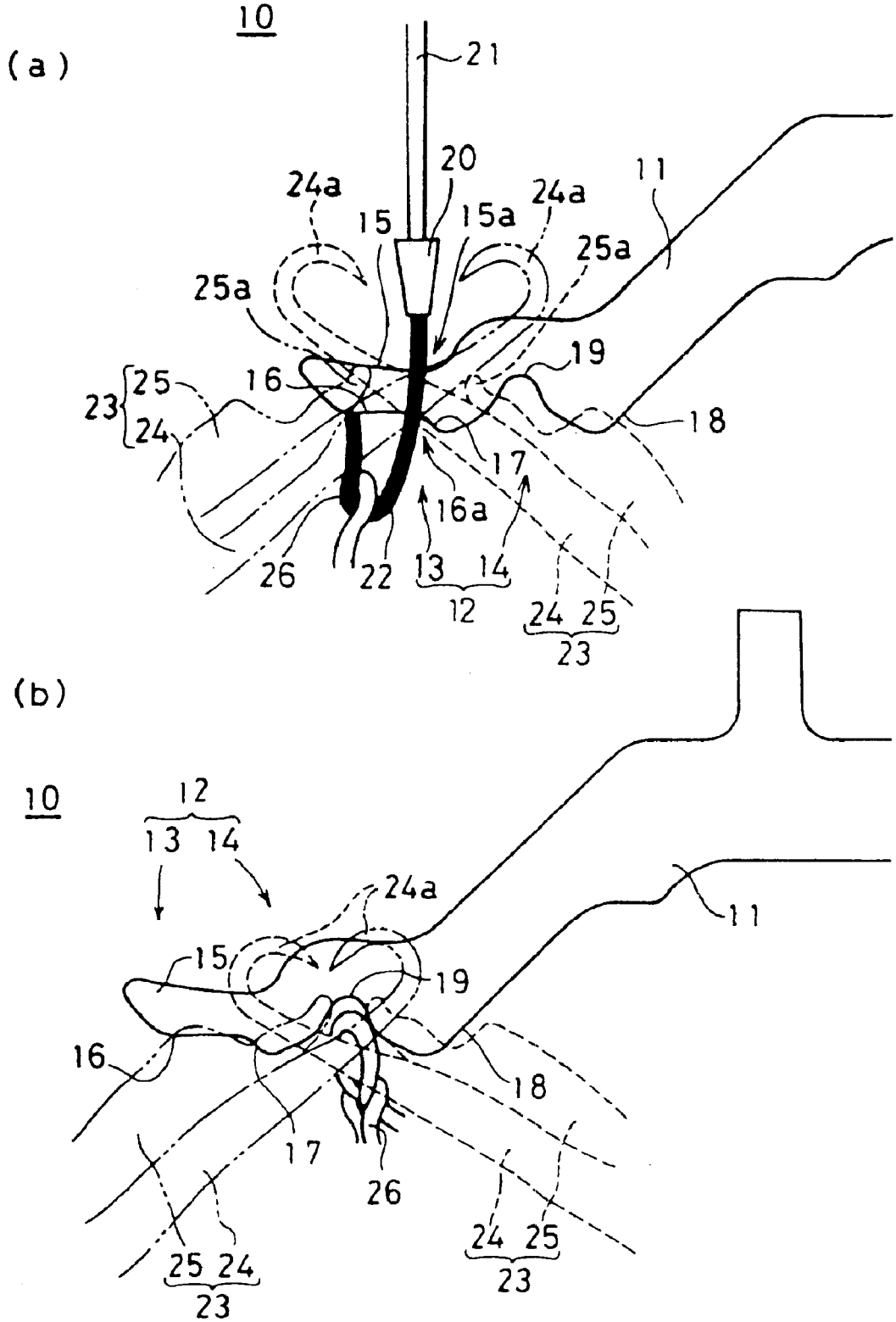
FIG. 1 is a partial side view showing a state in which a function is switched between a function of holding a knitting yarn for end stitches and a loop presser function with a loop presser 11 that is one embodiment of the invention.

Now referring to the drawings, preferred embodiments of the invention are described below.

FIG. 1 shows a shape of a top portion 12 of a loop presser 11 that is advanced in a tooth mouth 10 of a flat knitting machine that is one embodiment of the invention. The loop presser 11 is formed of a metal plate, and in the top portion 12, a knitting yarn holding portion 13 for end stitches and a loop presser portion 14 are provided in different positions. The loop presser 11 can advance and retract the top portion 12 to the tooth mouth 10. Regarding the advancing and retracting direction, the knitting yarn holding portion 13 for end stitches is provided nearer to the end side than a loop presser portion 14.

FIG. 1(*a*) shows a state in which the knitting yarn holding portion 13 for end stitches is positioned in the tooth mouth 10, and FIG. 1(*b*) shows a state in which the loop presser portion 14 is positioned in the tooth mouth 10. The knitting yarn holding portion 13 for end stitches has a shape including a wall portion 15 on an upper side and a pressing portion 16 on a lower side. The loop presser portion 14 has a shape including two loop pressing portions 17 and 18 on the lower side and a yarn guide portion 19 therebetween.

Figure 16:
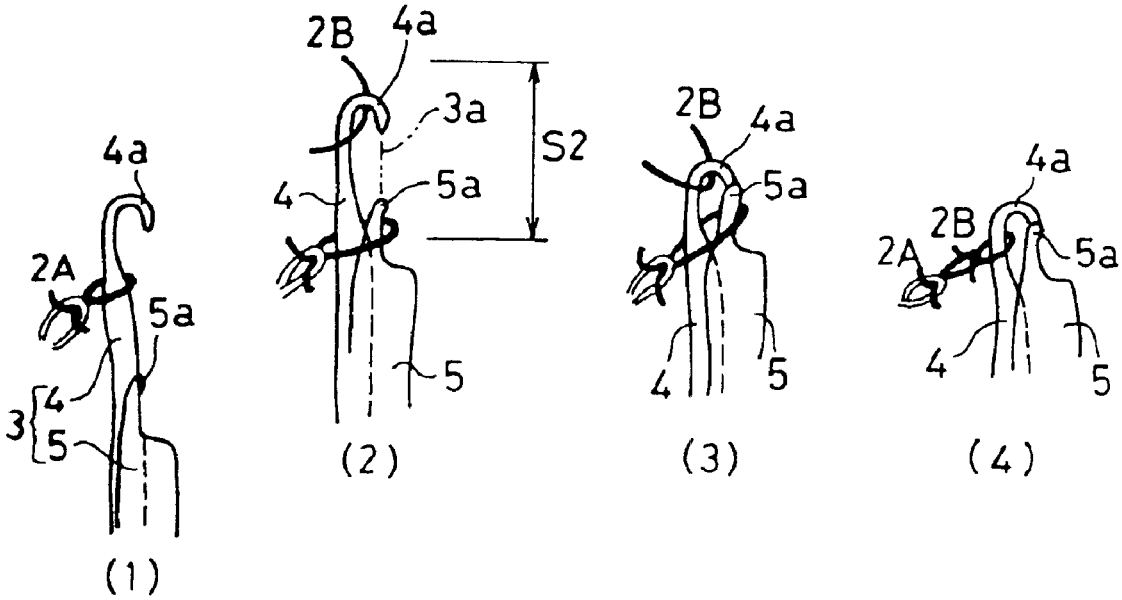
FIG. 16 is a view showing a knitting operation with a compound needle.

As shown in FIG. 1(*a*), above the tooth mouth 10, a yarn feeding port 20 is provided in the top of the yarn carrier 21 to feed a knitting yarn 22 to the tooth mouth 10. The tooth mouth 10 is opposed to the top of front and back needle beds provided in the flat knitting machine. Each needle bed is inclined such that the side of the tooth mouth 10 is lifted, and the side shape is an angle. In each needle bed, compound needles 23 are arranged as multiple knitting needles. The compound needle 23 of one of the front and the back needle beds is shown by an alternate long and short dash line, and the compound needle 23 of the other needle beds is shown by a broken line. In each needle bed, the compound needle 23 is reciprocated and displaced in a needle groove formed in a predetermined pitch to advance and retract its top side to the tooth mouth 10. The compound needle 23 is basically the same as the compound needle 3 shown in FIG. 16, and is constituted by a needle main body 24 and a slider 25. A hook 24*a* is formed on the top of the needle main body 24, and a tongue 25*a* is formed on the top of the slider 25.

Figure 13:
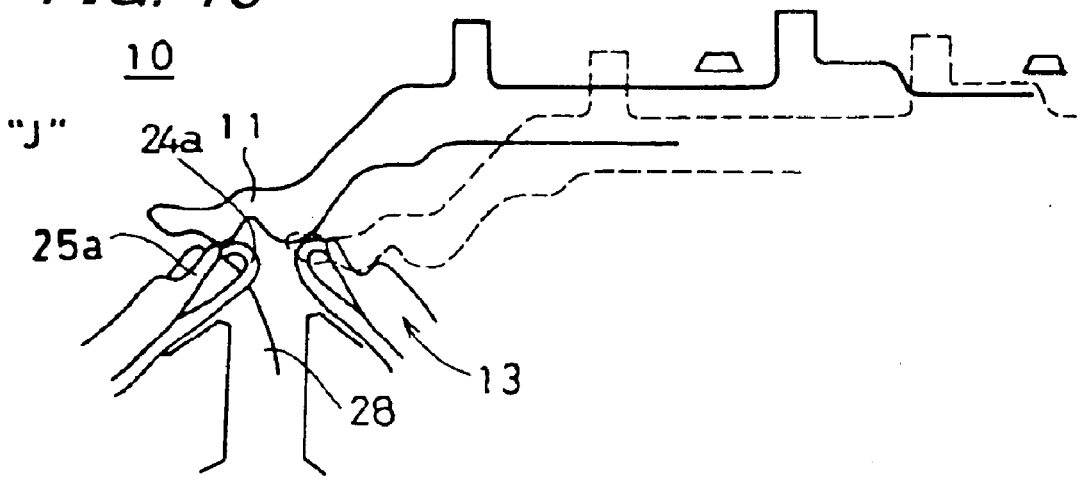
FIG. 13 is a view showing an advance state of the loop presser 11 at the position J of FIGS. 4 to 6.

FIG. 1(*a*) shows a state in which the compound needle 23 shown by the alternate long and short dash line reaches an end stitch, the yarn carrier 21 is moved from a far side of the drawing to a nearer side, a knitting stitch loop 26 in one course is made, knitting in the next course is started, and the knitting yarn holding portion 13 for end stitches of the loop presser 11 is advanced onto the nearer side than the compound needle 23. When the yarn feeding port 20 is still positioned before the knitting yarn holding portion 13, the knitting yarn 22 suspended from the knitting stitch loop 26 to the yarn feeding port 20 is pressed at a contact point 16*a* that establishes contact with the pressing portion 16. When the yarn carrier 21 is moved from the nearer side to the far side while keeping the advance state of the knitting yarn holding portion 13 for end stitches, the knitting yarn 22 is turned back by the knitting yarn holding portion 13 for end stitches, and brought in contact with the wall portion 15 at a contact point 15*a* and held. The knitting yarn 22 is pulled back to the far side with the movement of the yarn feeding port 20, and fed to the hook 24*a* for knitting in the next course. Thus, the process in the knitting end as shown in FIG. 13 of Japanese Patent No. 3044373 can be performed. Furthermore, in this embodiment, the top of the tongue 25*a* of the compound needle 23 is not projected beyond the wall portion 15 of the knitting yarn holding portion 13 for end stitches, and therefore the problem of yarn entanglement such as a situation where the knitting yarn 22 is surmounted on the tongue 25*a* of the slider 25 can be prevented. On the side farther than the knitting needle 23 for end stitches, the yarn guide portion 16 of the loop presser portion 14 is engaged with the knitting yarn 22 fed from the yarn feeding port 20 to the knitting needle 23 for end stitches so as to guide the yarn to the hook 24*a*.

As shown in FIG. 1(*b*), the loop presser portion 14 of the loop presser 11 has a shape including the loop pressing portions 17 and 18 for pressing the knitting stitch loop 26 made with the compound needles 23 of the front and back needle beds in the lower portion. The loop pressing portions 17 and 18 are on a slant face that is substantially perpendicular to the moving direction of the compound needle 23 advancing from the front and back needle beds, and the yarn guide portion 19 is formed in a recess therebetween. The yarn guide portion 19 has a function of reliably guiding the knitting yarn 22 fed from the yarn feeding port 20 to the hook 24*a*. The operation and the function of the loop presser that has two functions of the loop presser function and the yarn guiding function are basically the same as those in the loop presser described as a "best mode example" in the paragraphs [0066] to [0089] with reference to FIGS. 15 to 21 in Japanese Patent No. 3044373 in which a flat knitting machine using a latch needle is specifically described.

Figure 2:
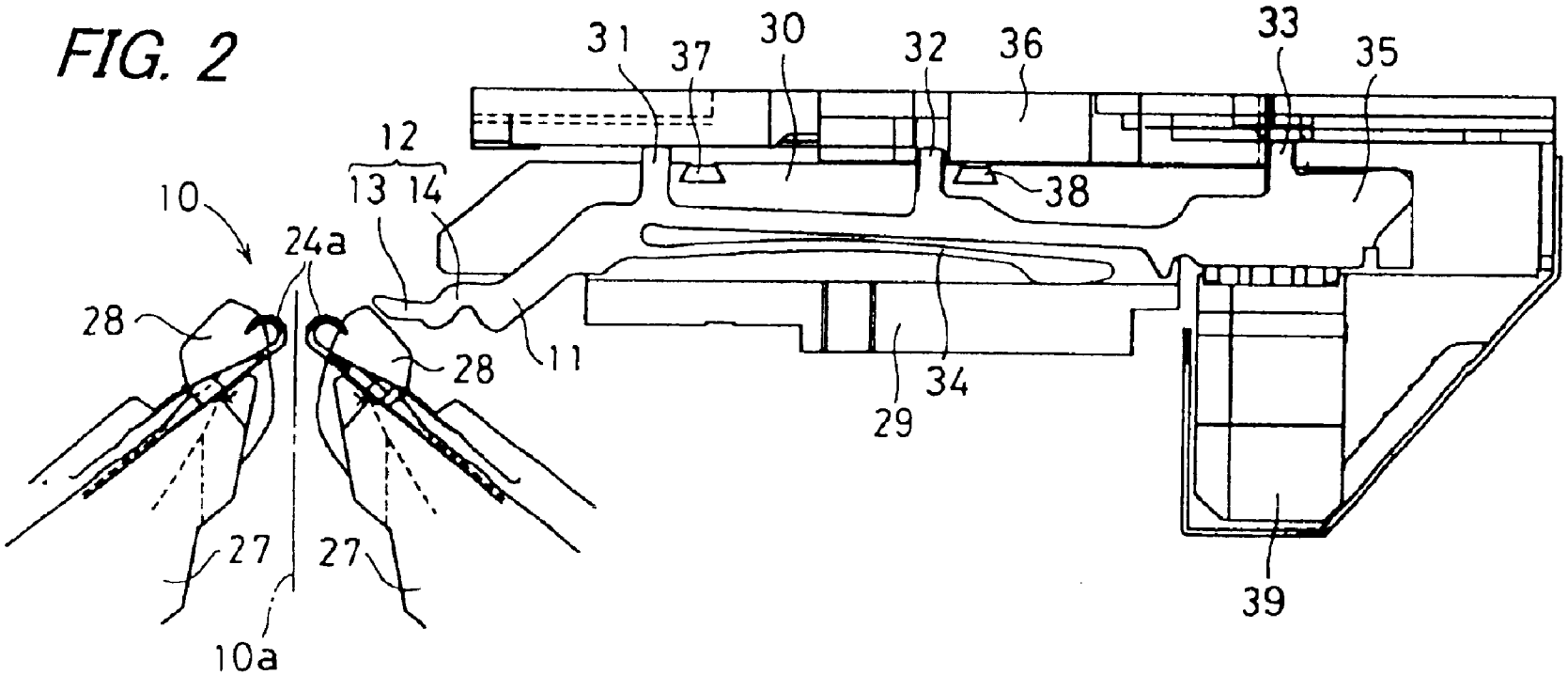
FIG. 2 is a partial cross sectional side view showing a schematic configuration of a flat knitting machine using the loop presser 11 of this embodiment.

FIG. 2 shows a simplified configuration in longitudinal section of a flat knitting machine using the loop presser 11 of FIG. 1. In the tooth mouth 10, at least one pair of front and back needle beds 27 is arranged linear-symmetrically with respect to a phantom central line 10*a* such that the head portions are opposed to each other at an angle. Three or more needle beds 27 can be provided. In each needle bed 27, a needle groove for guiding is formed so that the compound needle 23 can advance to and retract from the tooth mouth 10, and a sinker 28 for supporting a knitting yarn when the compound needle 23 draws the knitting yarn is provided along the needle groove on a head portion of each needle groove. An auxiliary bed 29 is provided above at least one of the front and back needle beds, for example, above the back needle bed, and a groove 30 for guiding the movement with which the loop presser 11 advances and retracts its top portion 12 to the tooth mouth 10 is formed. An arrangement pitch of the loop presser 11 corresponds to an arrangement pitch of the compound needle 23 in the needle bed 27. However, these arrangement pitches do not necessarily have to have one-to-one relation, but the pitch can be such that one loop presser 11 corresponds to a plurality of compound needles 23. The compound needle 23 and the loop presser 11 are displaced so as to advance to and retract from the tooth mouth 10 by a cam mechanism that is mounted on a carriage that can reciprocate in the longitudinal direction of the needle bed 27, that is, in the direction perpendicular to the sheet surface.

Figure 3:
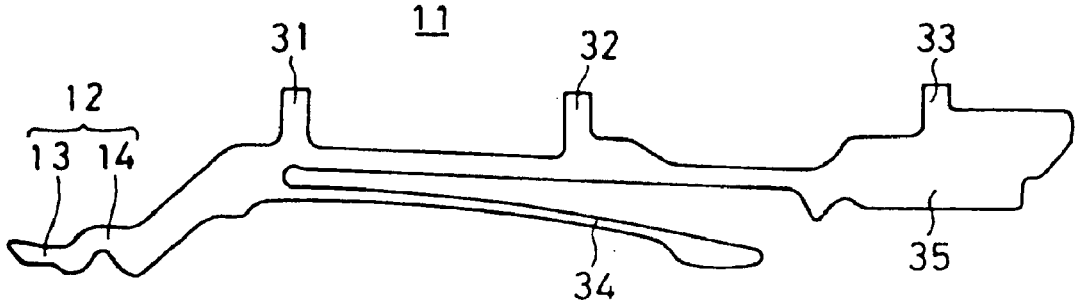
FIG. 3 is a side view showing the contour of the loop presser 11 of this embodiment.
Figure 3:
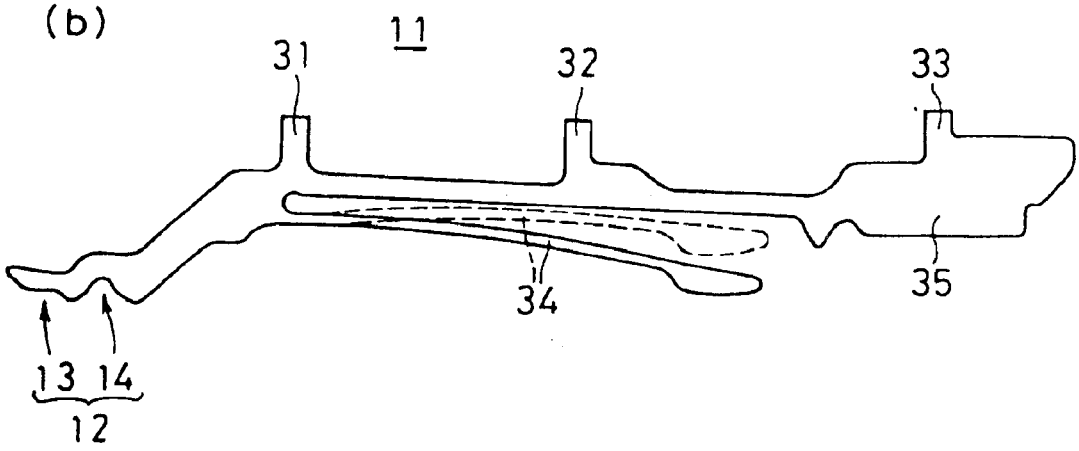

FIG. 3 shows a shape of the loop presser 11. In addition to the knitting yarn holding portion 13 for end stitches and the loop presser portion 14 in the top portion 12, as described above, the loop presser 11 has a shape in which a plurality of butts such as a first butt 31, a second butt 32 and a third butt 33 are projected upward over a portion from the front portion to the tooth mouth 10 to a rear portion apart from the tooth mouth 10. An elastic arm 34 that is branched from a front portion extends on a lower side of a middle portion of the loop presser 11. A base end portion 35 is provided in the rearmost portion of the loop presser 11. The bottom face of the base end portion 35 is flat. As shown in FIG. 3(*a*), when the loop presser 11 is in a free state in which no external force is applied to the loop presser, the elastic arm 34 is opened downward. As shown in FIG. 2, when the loop presser 11 is accommodated in the groove 30 of the auxiliary bed 29, an upper side of the loop presser 11 is in contact with the cam mechanism 36 and metal bands 37 and 38, and the lower side is in contact with the bottom face of the groove 30, so that the elastic arm 34 is bent by elastic deformation as shown by the broken line in FIG. 3(*b*).

As shown in FIG. 2, in the auxiliary bed 29, the rear portion of the groove 30 is open, and the base end portion 35 of the loop presser 11 is exposed from an open portion when the top portion 12 of the loop presser 11 is retreated from the tooth mouth 10. A selecting mechanism 39 for switching the function of the loop presser 11 utilizing magnetic force is provided below the open portion of the auxiliary bed 29. The base end portion 35 is urged to be apart from the surface of the selecting mechanism 39 by a resilient force of the elastic arm 34. When the cam mechanism 36 presses the third butt 33, the base end portion 35 comes down against the resilient force of the elastic arm 34, and the surface is attracted to the selecting mechanism 39 by the magnetic force. The selecting mechanism 39 has a permanent magnet and an electromagnet. When current flows through the electromagnet, an attracting force of the permanent magnet is cancelled, so that the base end portion 35 attracted by the permanent magnet is released. If current does not flow through the electromagnet, the base end portion 35 continues to be attracted in the range in which the base end portion 35 is in contact with the selecting mechanism 39.

Figure 4:
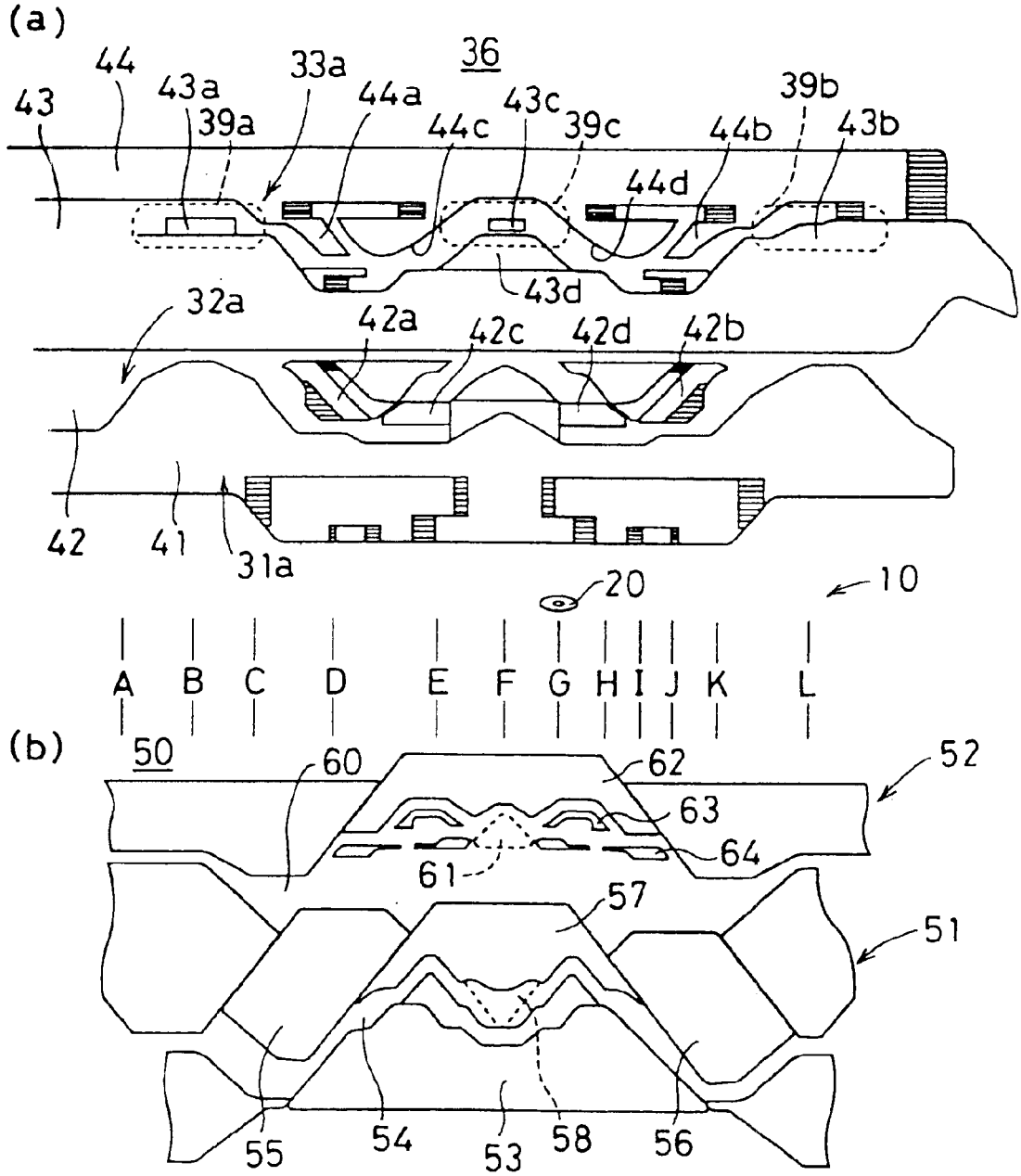
FIG. 4 is a sight-through view showing the configurations of a cam mechanism 36 for operating the loop presser 11 and a compound needle 23 and a cam mechanism 50 for knitting in this embodiment.
Figure 5:
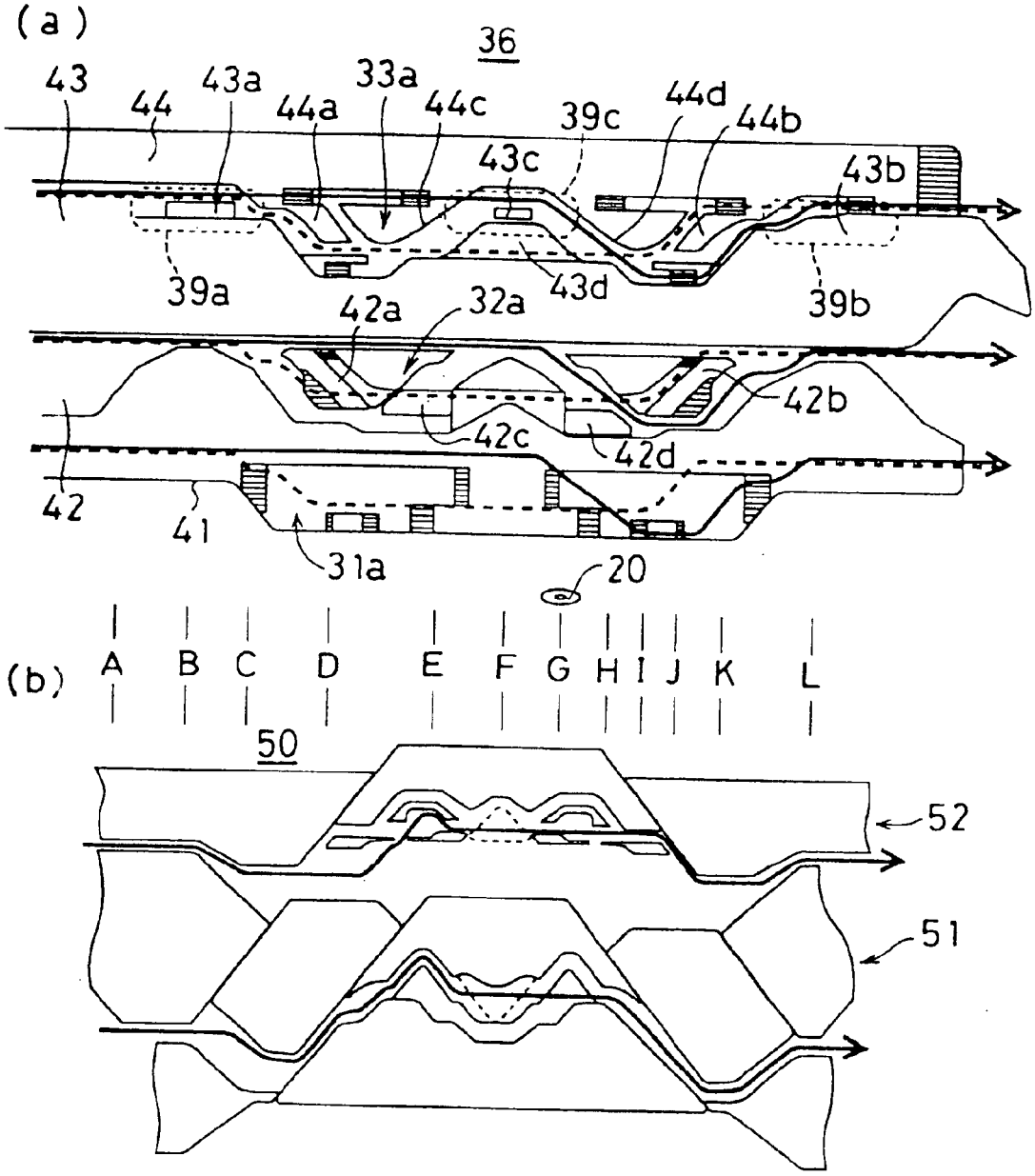
FIG. 5 is a sight-through view showing loci of the traveling of the butts of the loop presser 11 and the compound needle 23 in this embodiment.
Figure 6:
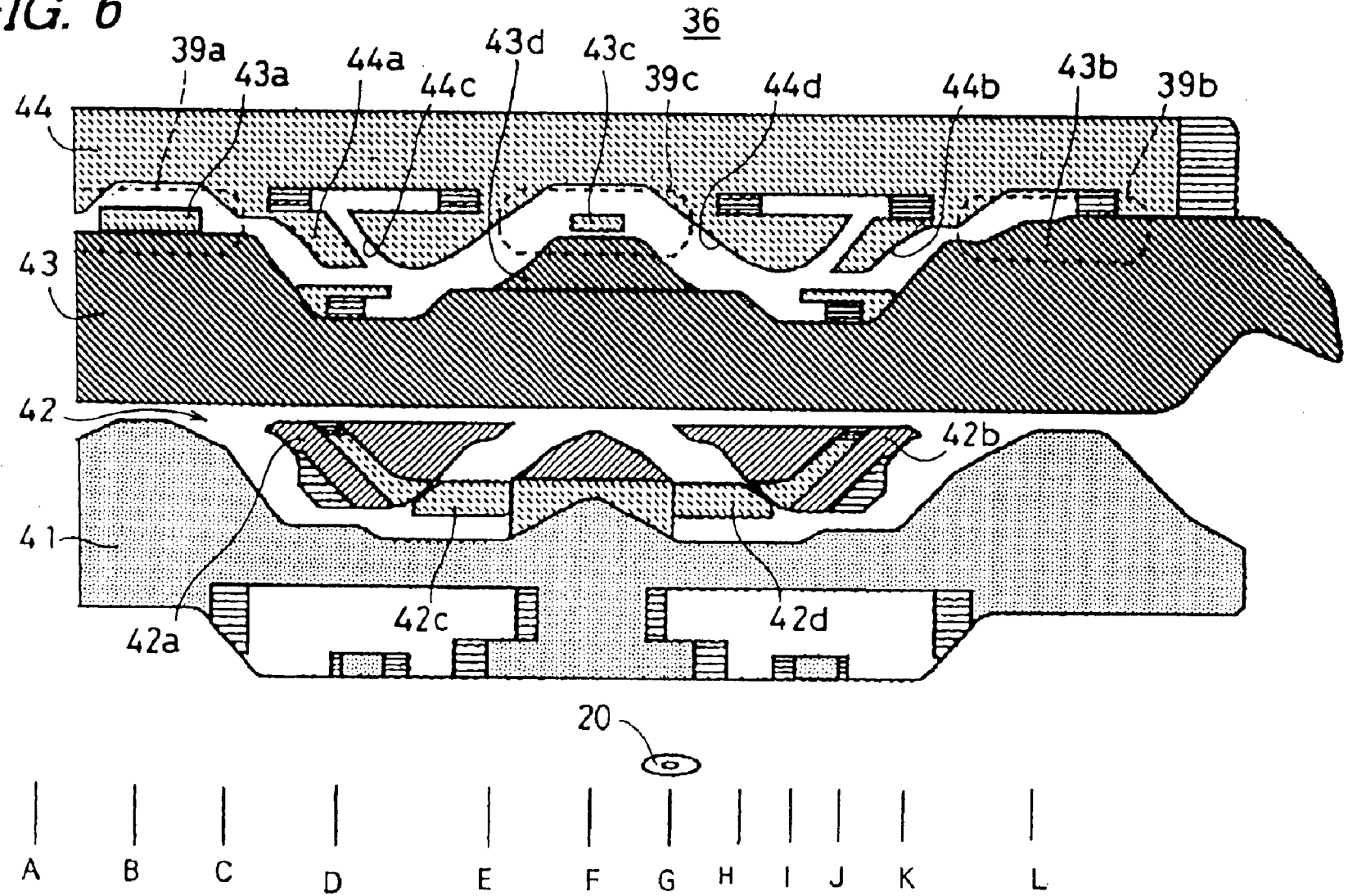
FIG. 6 is a simplified plan view showing the height of a cam plane in the cam mechanism 36 in this embodiment.

FIG. 4(*a*) shows a sight-through state of the cam mechanism 36 shown in FIG. 2 in such a manner that the lower side corresponds to a side of the tooth mouth 10. FIG. 4(*b*) shows a sight-through state of a knitting cam mechanism for advancing and retracting the compound needle 23 in such a manner that the upper side corresponds to the side of the tooth mouth 10. FIG. 5(*a*) shows passage loci of the first butt 31, the second butt 32, and the third butt 33 of the loop presser 11, and FIG. 5(*b*) shows passage loci of the compound needles. FIG. 6 shows the difference in the height of each portion of the cam mechanism 36 from the substrate. In FIGS. 4(*a*), 5(*a*) and 6, the hatched portion with parallel horizontal lines is an inclined surface. Reference numerals A, B, C, D, E, F, G, H, I, J, K, and L denote the positions referred to in the description below, in particular, reference numeral F indicates a central position and reference numeral G is a yarn feeding position from the yarn feeding port 20. The side of the tooth mouth corresponds to the lower portion of the drawings, but the operation of advancing the loop presser 11 to the side of the tooth mouth is referred to as "lifting", and the operation of retreating it from the side of the tooth mouth is referred to as "lowering".

As shown in FIG. 4(*a*), the cam mechanism 36 is generally provided with a first guide cam 41, a second guide cam 42, a third guide cam 43 and a fourth guide cam 44. A first cam track 31*a*, a second cam track 32*a*, and a third cam track 33*a* for acting on the first butt 31, the second butt 32 and the third butt 33 of the loop presser 11 are formed between the first guide cam 41 and the second guide cam 42, between the second guide cam 42 and the third guide cam 43, and between the third guide cam 43 and the fourth guide cam 44, respectively. Each guide cam is generally linear symmetrical in the horizontal direction of FIG. 4(*a*), and when the carriage travels in a reciprocating movement, the same action can be performed.

Hereinafter, the invention will be described, assuming that the carriage in which the cam mechanism 36 is mounted moves from the left to the right of the drawing. The selecting mechanism 39 is provided in three portions along the third cam track 33*a*. The selecting mechanism 39*a* on the leading side and the selecting mechanism 39*b* on the trailing side are provided in a symmetrical positions with respect to the center, and when the moving direction becomes opposite so that the carriages moves from the right to the left, the selecting mechanism 39*b* is on the leading side. A selecting mechanism 39*c* is provided in the center, and has a common function with respect to the reciprocating movement of the carriage. Along the second cam track 32*a*, lowering cams 42*a* and 42*b* that are urged by a spring to be projected from the substrate of the cam mechanism 36 are provided in symmetrical positions with respect to the center. Furthermore, pressing cams 42*c* and 42*d* that are urged by a spring to the direction away from the tooth mouth 10 are provided in symmetrical positions with respect to the center. Regarding the third cam track 33*a*, pressing projected portion 43*a*, 43*b* and 43*c* for pressing the third butt 33 of the loop presser 11 so that the base end portion 35 is attracted to the selecting mechanisms 39*a*, 39*b* and 39*c*, respectively, are provided. Furthermore, a projecting/retreating cam 43*d* whose surface can be projected and retreated from the substrate is provided in the central portion of the third guide cam 43. The fourth guide cam 44 is provided with lifting cams 44*a* and 44*b* serving to hold a knitting yarn for end stitches that advance the loop presser 11 by being engaged with the third butt 33, and lifting cams 44*c* and 44*d* serving as a loop presser.

FIG. 4(*b*) shows a schematic configuration of a knitting cam mechanism 50. The knitting cam mechanism 50 is constituted by a needle main body cam lock 51 and a slider operation cam lock 52. The needle main body cam lock 51 includes a raising cam 53 having a double hump shape, a pair of stitch cams 55 and 56 provided on both sides of the raising cam 53 so as to sandwich a butt path 54 for allowing passage of a butt provided in the needle main body 24 shown in FIGS. 1 and 2, and a bridge cam 57 disposed on the side of the tooth mouth 10 of the raising cam 53, and a transfer control cam 58 provided between the two humps of the raising cam 53. The raising cam 53 and the bridge cam 57 are formed as fixed cams. The stitch cams 55 and 56 can be displaced along a slant face in which they are in contact with the bridge cam 57 so that the size of the knitting stitch loop 26 to be knitted can be adjusted. The transfer control cam 58 can be switched so as to be projected or retreated. When it is projected, the hook 24*a* of the needle main body 24 is displaced to the position retracted farther from the tooth mouth 10 than a far end position of the knit state serving as the basis when knitting is performed, and a transfer operation in which the knitting stitch loop 26 is moved between the opposing needle beds.

The slider operation cam lock 52 includes a transfer control cam 61 that can be switched so as to be projected or retreated and fixed slider guide cams 62, 63, and 64 along a butt path 60 that allows the passage of the butt for advancement. When the transfer control cam 61 is projected, the tongue 25*a* of the slider 25 is advanced farther beyond the position of the hook 24*a* that is retreated as described above to the side of the opposing needle bed 27, and a transfer operation can be performed. Such a compound needle 23 is basically the same as that specifically described in Japanese Patent No. 3085657.

As shown in FIG. 5(*a*), the passage locus of each butt of the loop presser 11 when forming knitting stitches while the carriage is traveling to the right direction can be switched between the path shown by a broken line in which the knitting yarn holding portion 13 for end stitches functions, which can be obtained by operating the selecting mechanism 39*a*, and the path shown by a solid line in which the loop presser portion 14 functions, which can be obtained by operating the selecting mechanism 39*c*. The projecting/retreating cam 43*d* of the third guide cam 43 is set to be in the retreated state in which the surface is not projected. In the path shown by the broken line for the function of holding the knitting yarn for end stitches, in the third cam track 33*a*, the third butt 33 is guided by the lifting cam 44*a* in the positions corresponding to C to D, and the loop presser 11 is lifted to the side of the tooth mouth 10. Since the projecting/retreating cam 43*d* is retreated, the third butt 33 can pass above the projecting/retreating cam 43*d*. In the second cam track 32*a*, when the second butt 32 surmounts the lowering cam 42*a* in the position corresponding to D, the lowering cam 42*a* is retreated so as to be in the same height as the pressing cams 42*c* and 42*d* or the like, so that the second butt 32 is suppressed from going up all the way to the vicinity of the position corresponding to I. The pressing cam 42*d* keeps its position that is symmetrical with the pressing cam 42*c* with respect to the central line by being urged by a spring, as shown in FIG. 4(*a*). FIG. 5(*a*) shows the state after the second butt 32 moved the position of the pressing cam 42*d* in the loop presser function as described later. In the third cam track 33*a*, after the position corresponding to I, the lowering cam 42*b* acts on the third butt 33 so as to move the loop presser 11 in the direction away from the tooth mouth 10.

In the path shown by the solid line for the function as the loop presser, the lifting cam 44*d* of the fourth guide cam 44 guides the third butt 33 in the positions corresponding to G to H, and the top of the lowering cam 42*b* guides the second butt 32 after the position corresponding to I so that the loop presser 11 can be advanced farther to the side of the tooth mouth than the path for serving the function of holding a knitting yarn for end stitches. When the second butt 32 passes by the position of the pressing cam 42*d*, as shown in FIG. 5(*a*), the pressing cam 42*d*, urged by a spring upward in FIG. 5(*a*), can be moved downward by the front edge of the second butt 32 so as to obtain a passage.

FIG. 5(*b*) shows the passage locus when knitting operation is performed with the compound needle 23 in the knitting cam mechanism 50. When the releasing operation is not performed either in the selecting mechanism 39*a* or 39*b*, the loop presser 11 does not advance to the tooth mouth 10 and stays in a rest position.

As shown in FIG. 6, a difference in the height from the substrate is provided on the cam surface of the cam mechanism 36. The surface in which the density of filling shown by hatching with oblique lines or halftone dots is high is positioned higher than the substrate surface that is blank. However, as described above, the portion hatched with parallel horizontal lines is an inclined surface. The third guide cam 43 that is hatched with oblique solid lines descending to the right is the highest. The fourth guide cam 44 that is hatched with oblique broken lines descending to the right is lower than the third guide cam 43. The first guide cam 41 that is filled with halftone dots is lower than the fourth guide cam 44. The second guide cam 42, hatched with oblique lines ascending to the right in the state where the lowering cams 42*a* and 42*b* are projected, is the second highest after the third guide cam 43, and higher than the other cams including pressing cams 42*c* and 42*d* of the second guide cam 42. The other cams, such as the pressing cams 42*c* and 42*d* of the second guide cam 42, are equal to the fourth guide cam 44. Regarding the projecting/retreating cam 43*d* of the third guide cam 43, the state in which it is projected from the substrate surface, and its height from the substrate surface is highest, as the other portions of the third guide cam 43. Thus, when the projecting/retreating cam 43*d* is projected, the loop presser 11 that once is lifted can be returned in the center.

As described above, in the locus for the function of holding a knitting yarn for end stitches, when the second butt 32 is surmounted on the surface of the lowering cam 42*a* from the inclined surface in the position corresponding to D, the lowering cam 42*a* sinks until its height becomes equal to the pressing cams 42*c* and 42*d* or the fourth guide cam 44. The second butt 32 continues to be pressed at the surface of the same height such as the pressing cams 42*c* and 42*d* until it reaches the position corresponding to I. When the second butt 32 reaches the position corresponding to I, the second butt is in contact with the cam surface of the lowering cam 42*b* that is arranged symmetrically with the lowering cam 42*a*. The height in the state where the lowering cam 42*b* is projected is higher than the pressing cam 42*c* or the like, so that the second butt 32 in contact with the cam surface is guided along the cam surface and retreated from the tooth mouth side.

FIGS. 7, 8, 9, 10, 11, 12 and 13 show the state in which the loop presser 11 is advanced to the tooth mouth 10 in the positions D, E, F, G, H, I and J shown in FIGS. 4 to 6, respectively. The broken lines show the state in which the function of holding a knitting yarn for end stitches is served, and the solid lines show the state in which the loop presser function is served. The configuration in the vicinity of the tooth mouth 10 is based on the configuration of FIG. 2, which is simplified in the drawings for convenience. Moreover, the knitting yarns and knitting stitch loops are omitted, and the positional relationship in which the top portion of the loop presser 11 is advanced to the tooth mouth 10 is mainly shown. FIG. 1(*a*) corresponds to FIG. 10 at the position G, and FIG. 1(*b*) corresponds to FIG. 12 at the position I. Hereinafter, the invention will be described with reference to FIGS. 2 to 13. The loop presser 11 for which the path for serving the function of holding a knitting yarn for end stitches is selected is referred to as "end LP" for convenience, and the loop presser 11 for which the path for serving the loop presser function is selected is referred to as "knit LP" for convenience. The rest position of the end LP and the knit LP is the position in which each butt is in the uppermost position in FIG. 5(*a*).

Position A (Before Reaching the Knitting Cam)

End LP rest position knit LP rest position needle rest position.

In this position, the surface to be attracted of the base end portion 35 of the loop presser 11 is positioned in the open portion of the rear portion of the auxiliary bed 29. The upper surface of the main portion on the rear side of the second butt 32 is in contact with the metal band 38 provided in the auxiliary bed 29 so that the elastic arm 34 is compressed and deformed and the elastic arm 34 is pressed downward. The base end portion 35 of the loop presser 11 is urged by the resilient force to be projected upward.

Position B (Selecting Mechanism 39*a* is Attracted)

End LP rest position knit LP rest position needle rest position.

The third butt 33 of the loop presser 11 is pressed by the pressing projecting portion 43*a*, which is a presser for the third butt integrally formed with the fourth guide cam 44. At this time, the first butt 31 is in contact with the surface of the first guide cam 41, the loop presser 11 is swung in the counterclockwise direction with the contact portion of the first butt and the first guide cam 41 as the swinging pivot point and the surface to be attracted of the base end portion 35 is in contact with the attraction surface of the selecting mechanism 39*a* provided on the leading side, and attracted.

Position C (After Passing the Leading Selecting Mechanism 39*a*)

End LP a little advanced knit LP rest position needle rest position.

After the position B, the surface to be attracted of the base end portion 35 reaches the magnetic pole portion while being attracted to the selecting mechanism 39*a*, and the base end portion 35 of the end LP whose attraction is cut off there is swung upward by the resilient force of the elastic arm 34. Therefore, the third butt 33 is projected from the surface of the auxiliary bed 29, and engaged with the lifting cam surface of the lifting cam 44*a* of the fourth guide cam 44 so that the loop presser starts to advance to the tooth mouth 10. The loop pressers 11 other than the loop presser 11 selected as the end LP move straight in a lateral direction in the state where the base end portion 35 is attracted and held by the attraction surface of the selecting mechanism 39*a*. When the end LP advances, the contact between the metal band 38 and the upper edge of the end LP is cut off, and the first butt 31 enters the recess of the first guide cam 41 and is released from the pressing by the cam surface, so that the main portion of the end LP is pushed upward by the resilient force of the elastic arm 34, but the end LP holds its position in the groove 30 while the upper surface of the base end portion 35 is in contact with the surface of the fourth guide cam 44, and the upper surface of the main portion between the first butt 31 and the second butt 32 is in contact with the metal band 37 by pressure.

Position D (First Inclined Surface of the Raising Cam 53)

End LP advanced position knit LP rest position needle a little advanced.

Figure 7:
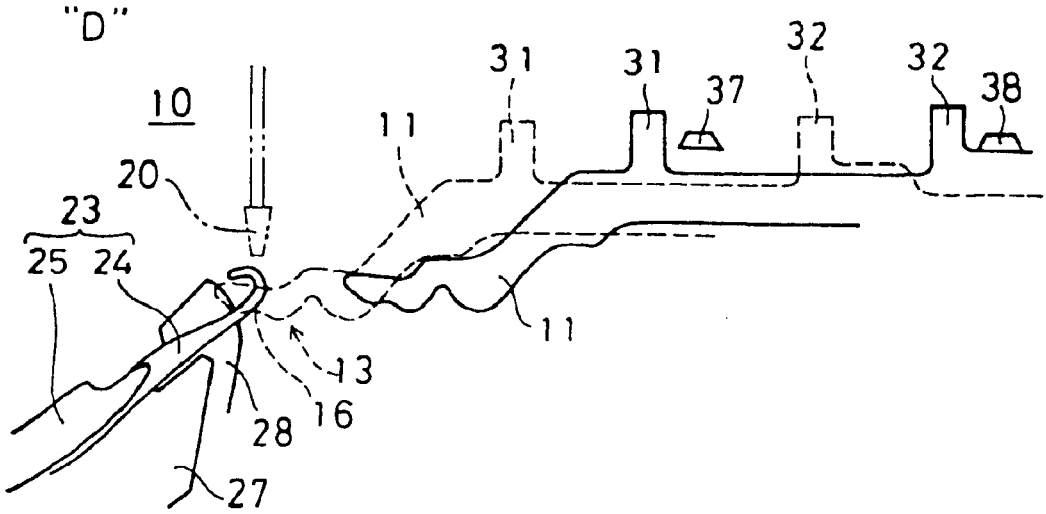
FIG. 7 is a view showing an advance state of the loop presser 11 at the position D of FIGS. 4 to 6.

The third butt 33 of the end LP is guided up to the top portion of the lifting cam surface of the lifting cam 44*a* of the fourth guide cam 44, the end of the knitting yarn holding portion 13 for end stitches traverses the sinker 28 of the opposing needle bed 27 when viewed from the side, as shown in FIG. 7, and the gap of the tooth mouth 10 is closed. The second butt 32 is subjected to its presser function at the potion of the lowering cam 42*a*, which is a projecting/retreating cam (raising cam) for the second butt provided in the rear of the second guide cam 42. The pressing portion 16 on the lower side of the knitting yarn holding portion 13 for end stitches presses a knitting yarn suspended from a knitting stitch loop held by the compound needle 23 to the yarn feeding port 20. The end LP advances up to the position H while keeping the posture at the position D.

Position E (the Most Advanced Position of Knitting Needle)

End LP advanced position knit LP rest position needle the most advanced position (top of the raising cam 53).

Figure 8:
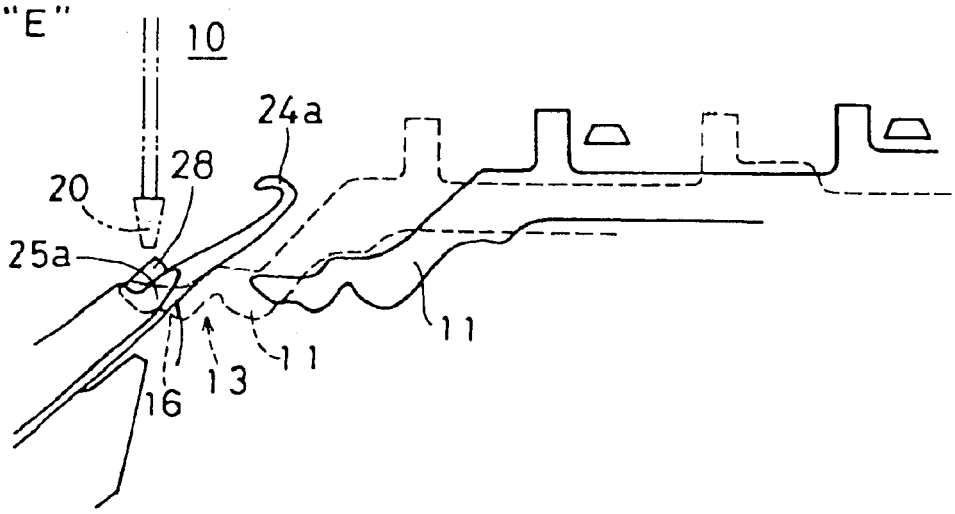
FIG. 8 is a view showing an advance state of the loop presser 11 at the position E of FIGS. 4 to 6.

As shown in FIG. 8, the hook 24*a* and tongue 25*a* are lifted to the most advanced position. The knitting stitch loop is held in a shoulder portion of the tongue 25*a*, and a suspended knitting yarn is pressed by the pressing portion 16 of the knitting yarn holding portion 13 for end stitches reliably.

Position F (Lower Position at the Bridge Cam 57)

End LP advanced position knit LP rest position needle as high as the fed yarn.

Figure 9:
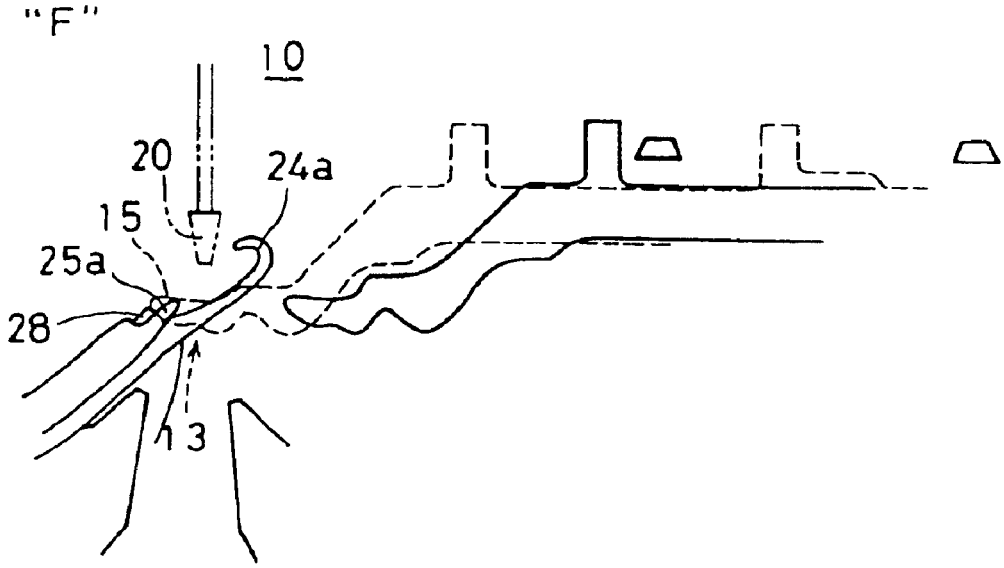
FIG. 9 is a view showing an advance state of the loop presser 11 at the position F of FIGS. 4 to 6.

As shown in FIG. 9, the hook 24*a* and tongue 25*a* are lowered and the hook 24*a* is as high as the fed yarn. The top of the tongue 25*a* is limited to be not above the wall portion 15.

Position G (After Passing the Selecting Mechanism 39*c* in the Middle Row)

End LP advanced position knit LP a little advanced needle as high as the fed yarn.

Figure 10:
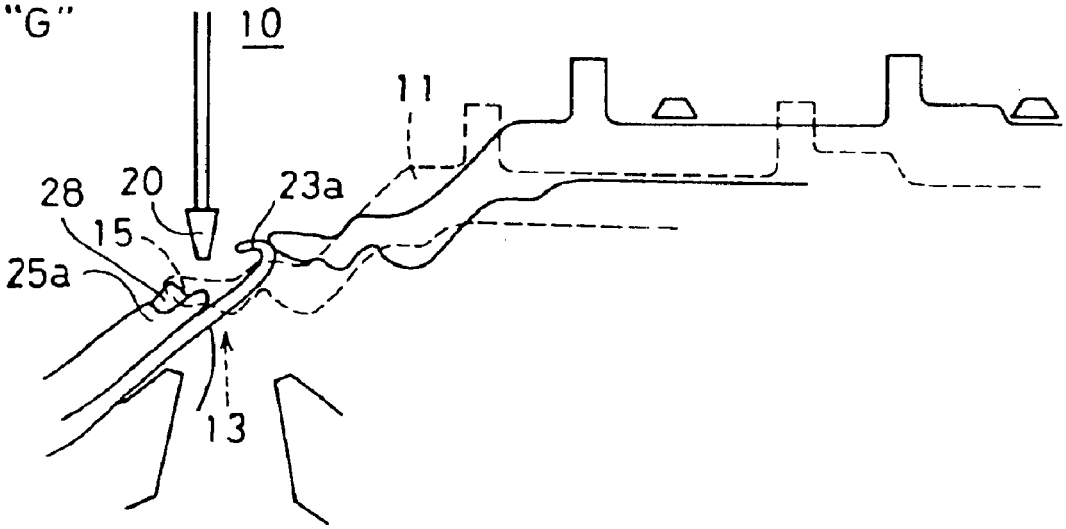
FIG. 10 is a view showing an advance state of the loop presser 11 at the position G of FIGS. 4 to 6.

As shown in FIG. 10, the yarn feeding port 20 passes through. The top of the tongue 25*a* is hidden by the wall portion 15 of the end LP. The loop pressers 11 other than the end LP reaches the magnetic pole portion in the state where the surface to be attracted of the base end portion 35 is attracted to the selecting mechanism 39*c* provided in the middle row, and the third butt 33 of the knit LP whose attraction is cut off is projected from the surface of the auxiliary bed 29, and starts to advance toward the tooth mouth 10, engaging the cam surface of the lifting cam 44*d* of the fourth guide cam 44.

Position H (Root Crossing Portion of the End LP and the Knit LP)

End LP advanced position knit LP advanced to the middle needle as high as the fed yarn.

Figure 11:
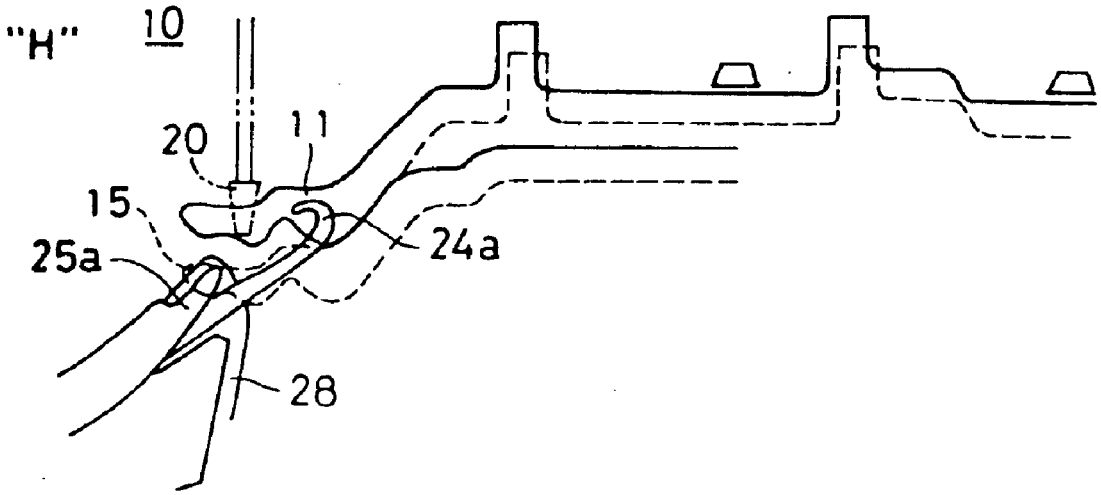
FIG. 11 is a view showing an advance state of the loop presser 11 at the position H of FIGS. 4 to 6.

As shown in FIG. 11, the knit LP advances to the tooth mouth 10 and starts to serve as a yarn guide. As shown in FIG. 5(*a*), the second butt 32 presses the pressing cam 42*c* from its side and moves it, which results in a locus in which it advances into the tooth mouth 10 beyond in the end LP.

Position I

End LP advanced position knit LP advanced position needle descending.

Figure 12:
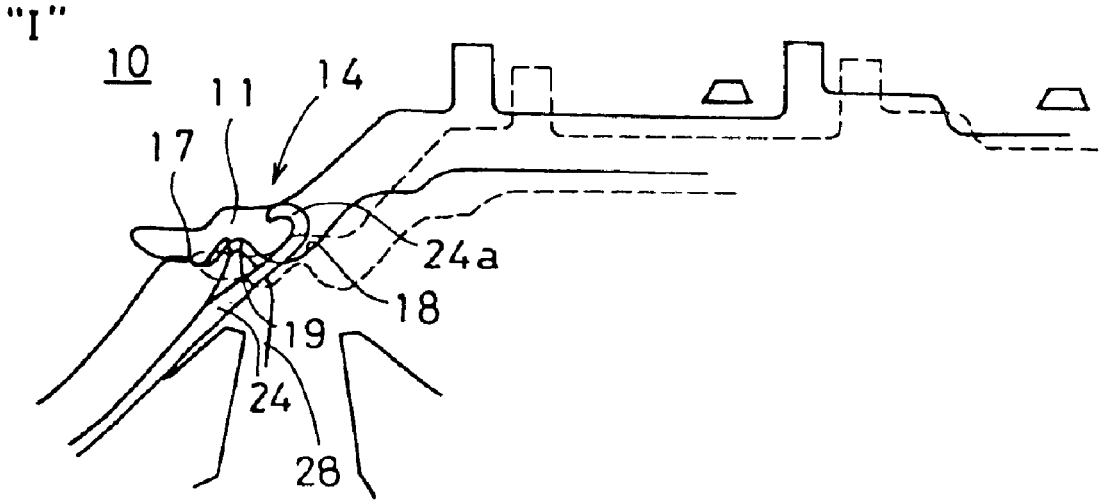
FIG. 12 is a view showing an advance state of the loop presser 11 at the position I of FIGS. 4 to 6.

As shown in FIG. 12, the needle main body 24 starts to descend at the lowering cam surface of the bridge cam 57. The second butt 32 of the knit LP drives away the pressing cam 42*d* and is engaged with the top surface of the lowering cam 42*b* that took over so as to be guided to the cam top portion. A knitting yarn is guided to the advancing and retracting locus of the hook 24*a* with the yarn guide portion 19 of the loop presser portion 14. The top of the tongue 25*a* is hidden so that the knitting yarn extending from the yarn feeding port 20 is not directly surmounted on the slider 25 by allowing the end LP to cooperate with the knit LP, that is, by the wall portion 15 of the end LP, and the knitting yarn above the slider 25 is moved to the advancing and retracting locus of the hook 24*a* near the center of the tooth mouth 10 by the yarn guide portion 19 in the knit LP while being in contact with the wall portion 15 of the end LP, so that the knitting yarn can be held by the needle hook reliably. The knitting stitch loop that is made is pressed by the loop pressing portions 17 and 18 of the knit LP, and the function as a loop presser which is the same as the conventional loop presser, can be served.

Position J (Position of an Inclined Surface of the Stitch Cam 56)

End LP start to descend (the second butt 32 is engaged with the lowering cam surface of the lifting cam 42*b*)

knit LP advanced position needle in the process of retracting with the stitch cam (the slider 25 also is descending).

As shown in FIG. 13, the end LP retreats and releases the knitting yarn held by the knitting yarn holding portion 13 for end stitches.

Position K (Position of a Flat Portion of the Stitch Cam)

End LP rest position knit LP start to descend needle height for stitch determination (the third butt 33 is engaged with the lowering cam surface of the third guide cam 43).

Position L (Position After Passing the Stitch Cam)

End LP rest position knit LP rest position needle rest position

Figure 14:
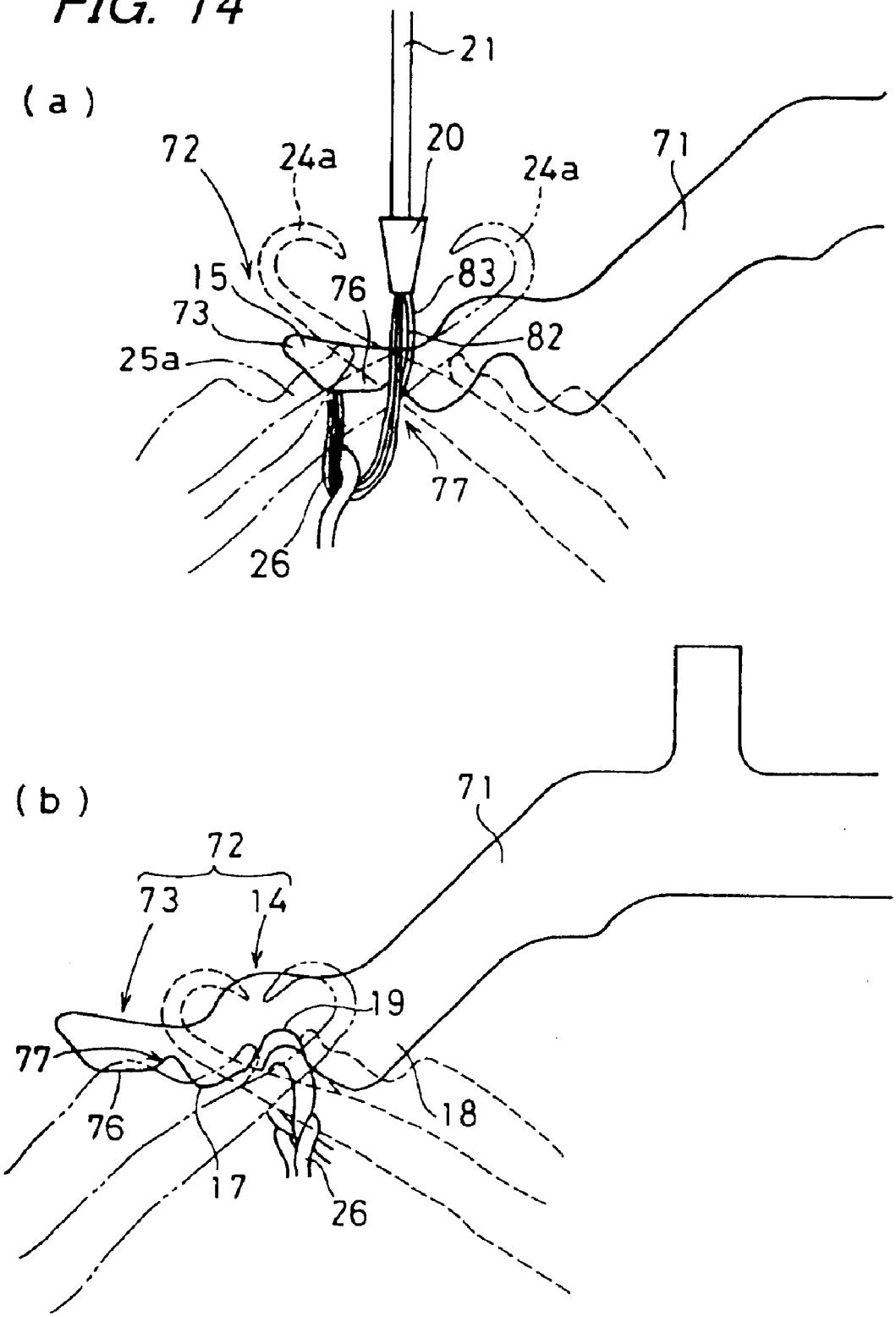
FIG. 14 is a partial side view showing the state in which a function is switched between a function of holding a knitting yarn for end stitches and a loop presser function with a loop presser 71 that is another embodiment of the invention.
Figure 15:
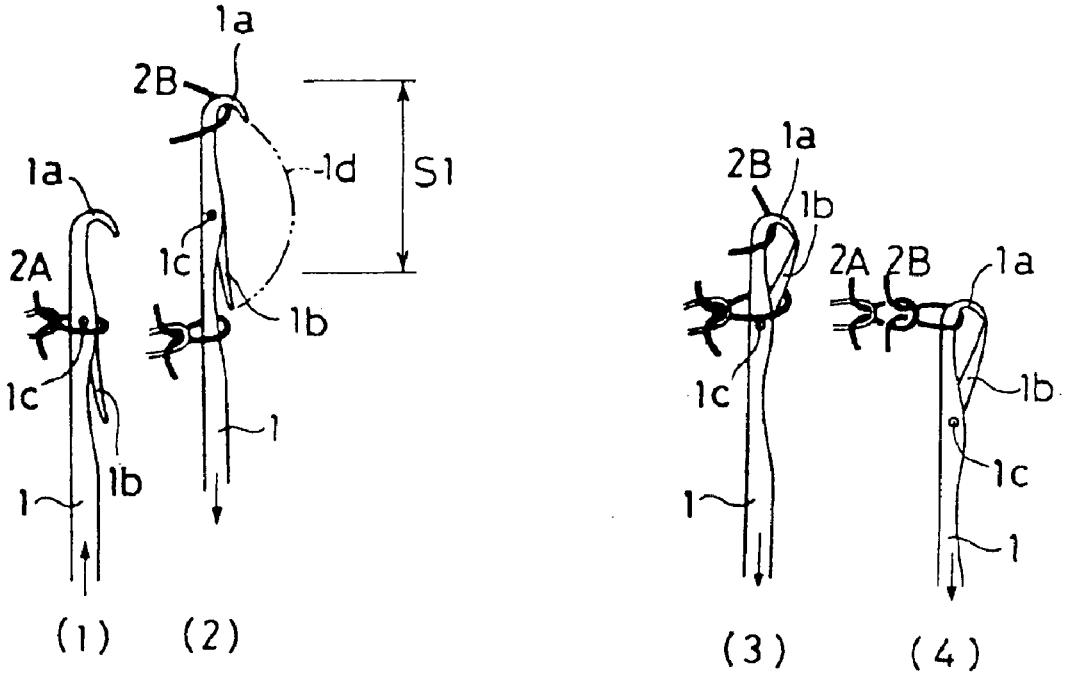
FIG. 15 is a view showing a knitting operation with a latch needle.

FIG. 14 shows a shape of a top portion 72 of a loop presser 71 that is another embodiment of the invention. In this embodiment, the portions corresponding to those of the embodiment of FIG. 1 are denoted by the same reference numerals, and the duplicated description will be omitted. In this embodiment, as shown in FIG. 14(*a*), a recess 77 is formed in a pressing portion 76 of a knitting yarn holding portion for end stitches 73. Thus, even if a knitting yarn 82 made of multiple yarns in which a plurality of fine yarns 83 are bundled is used, they can be converged on the recess 77, so that the problem of yarn entanglement can be prevented reliably. As shown in FIG. 14(*b*), the function at the loop presser portion 14 is the same as that of the loop presser 11 shown in FIG. 1(*b*).

In the embodiments described above, the knitting yarn holding portion 13 for end stitches and 73 are formed on the side of the top of the top portion 12 and 72 of the loop presser 11 and 71, and the loop presser portion 14 is formed on the side of the base end. However, The knitting yarn holding portion for end stitches can be positioned on the side of the base end. However, when the same loop pressing portions 17 and 18 and the yarn guide portion 19 as those of the loop presser portion 14 of the embodiments of the invention are formed in the loop presser portion, it is preferable that the knitting yarn holding portion 13 and 73 for end stitches are positioned on the top side, because after the functions as the end LP as shown in FIGS. 7 to 13 are served, the loop presser can be easily pulled out from the held knitting stitch loop.

In the flat knitting machine provided with the loop presser of the invention, the selecting mechanisms 39*a*, 39*c* and 39*b* of the loop presser are provided in the leading, the middle and trailing rows, respectively, with respect to the traveling direction of the carriage. Therefore, for example, in the case of knitting a knitted fabric in which there is no need of considering the problem of yarn entanglement of end stitches, a loop presser corresponding to a knitting needle used for knitting in the leading selecting mechanism is selected, and the knitting needle advances to the tooth mouth 10, the previous loop stopped by a needle hook is pressed so that the previous loop is not lifted with the advance movement of the needle main body 24 and it is guaranteed that the previous loop is cleared. In this case, the projecting/retreating cam 43*d* is set to the state where it is projected as shown in FIG. 6. For example, in the case where the knitting operation to be performed is stitch transfer, the configuration can be such that the loop presser corresponding to the knitting needle that performs stitch transfer traces the same route as that of the end LP of the above embodiments. In the case where the knitting operation to be performed is involved in formation of a knitting stitch, of the loop pressers corresponding to the knitting needle used for knitting, odd numbered loop pressers are allowed to act using the leading selecting mechanism so that previous loops are prevented from being lifted together. Then, the remaining even numbered loop pressers are selected with the following middle selecting mechanism, so that the knitting yarn can be guided to the hook by the even numbered loop pressers.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

Industrial Application

As described above, according to the invention, the top portion of the loop presser has a loop presser portion serving a function of pressing the knitting stitch loop by advancing to a tooth mouth of a flat knitting machine and a knitting yarn holding portion for end stitches serving a function of holding a knitting yarn fed from above the tooth mouth in the outside of a knitting end of a knitted fabric in the width direction in different positions in the advancing and retracting direction. Therefore, the portion that acts on the tooth mouth is changed to obtain a shape for exclusive purpose for each function, so that each function can be improved.

In addition, the upper side of the knitting yarn holding portion for end stitches can be utilized as a wall portion preventing the knitting yarn fed from the yarn feeding port from approaching a tongue top in a state where a needle hook of the compound needle is open by making (1) the loop presser for holding the knitting yarn in the outside of the knitting end of the knitted fabric and (2) another loop presser for pressing the knitting stitch loop knitted by guiding the yarn fed from the yarn feeding port to the compound needle for knitting the knitted fabric cooperate. Therefore, when knitting a knitting stitch of a knitting end in the width direction of a knitted fabric, the knitting yarn can be guided in the hook such that the problem of yarn entanglement in which the knitting yarn is surmounted on the tongue of the slider and goes outside the hook can be prevented.

According to the invention, the knitting yarn holding portion for end stitches is formed nearer to the top of the advancing and retracting direction than the loop presser portion. Therefore, the loop presser portion can be larger than the yarn guide portion for end stitches, and the stiffness can be increased so that the knitting stitch loop can be pressed sufficiently.

According to the invention, the knitting yarn holding portion for end stitches has a recess on which a knitting yarn made of multiple yarns that is formed with a bundle of a plurality of fine yarns are converged on its lower side. Therefore, the knitting yarn made of multiple yarns is prevented from spreading and a part thereof is prevented from contacting the tongue top in the state where the needle hook of the compound needle is open.

Furthermore, according to the invention, the flat knitting machine comprises a loop presser including a loop presser portion serving a function of pressing the knitting stitch loop by advancing to a tooth mouth and a knitting yarn holding portion for end stitches serving a function of holding a knitting yarn fed from above the tooth mouth in the outside of a knitting end of a knitted fabric in the width direction in different positions in the advancing and retracting direction.

During knitting a knitted fabric, after a knitting yarn is fed from a yarn feeding port to the hook of the compound needle, the top portion of the loop presser can be advanced to the tooth mouth with a loop presser mechanism such that the loop presser portion is positioned in the tooth mouth. When a knitting end is made and the traveling direction of the yarn feeding port is reversed to start the next course, then the top portion of the loop presser can be advanced to the tooth mouth with the knitting yarn holding mechanism for end stitches such that the knitting yarn holding portion for end stitches of the loop presser is positioned on the side before the compound needle used at first for knitting in the tooth mouth. In the loop presser, the portion that acts on the tooth mouth is changed to obtain a shape for the exclusive purpose of each function so that each function can be improved. When the loop presser using the knitting yarn holding portion for end stitches and the loop presser using the loop presser portion are made to cooperate, even if the knitting yarn in the knitting end is held by the knitting yarn holding portion for end stitches and the knitting yarn is guided to the compound needle used at first in knitting of a next course by the loop presser portion, the tongue top of the slider is hidden by the wall portion on the upper side of the knitting yarn holding portion for end stitches, whereby the problem of yarn entanglement in which the knitting yarn is surmounted on the tongue and goes outside the hook can be prevented.

According to the invention, the auxiliary bed in which the loop presser advances and retracts is open downward on a base end side of the advancing and retracting direction, and a selecting mechanism is positioned below the open portion. The selecting mechanism attracts the base end side of the loop presser and can release the attraction selectively. The loop presser has a butt projected upward. A cam mechanism is provided above the auxiliary bed, and in the cam mechanism, a cam groove that is engaged with the butt and drives the butt to be displaced in the advancing and retracting direction is formed. The cam mechanism can switch function, either as the loop presser mechanism or the knitting yarn holding mechanism for end stitches, by selecting the cam groove engaged with the butt by releasing attraction to the base end portion of the loop presser with the selecting mechanism or not. Thus, switching can be performed with a single cam mechanism.

According to the invention, the cam groove of the cam mechanism is formed generally in linear symmetry with respect to a central line, and the top portion of the loop presser draws the same locus at the time of knitting on one side of a needle bed as that at the time of knitting on the other side, and the selecting mechanisms opposed with respect to the central line of the cam mechanism also can switch the cam groove in the reciprocal direction.

Furthermore, according to the invention, when knitting a knitted fabric with a flat knitting machine comprising at least a pair of needle beds in the front and the back, knitting can be performed reliably with a compound needle, using a loop presser having a portion serving a function of pressing a knitting stitch loop by advancing to a tooth mouth and a portion serving a function of holding a knitting yarn fed from above the tooth mouth in the outside of a knitting end of a knitted fabric in the width direction in different positions in the advancing and retracting direction. After a knitting yarn is fed to the hook of the compound needle, the loop presser advances the portion having the loop presser function of pressing a knitting stitch loop on the lower side to the tooth mouth, and advances the portion serving the knitting yarn holding function for end stitches of holding a knitting yarn fed from above the tooth mouth in the outside of the knitting end of the knitted fabric in the width direction, so that the function can be switched. Therefore, the portion that acts on the tooth mouth can be changed to obtain a shape for exclusive purpose for each function, so that each function can be improved.

The upper side of the portion serving the knitting yarn holding function for end stitches is utilized as a wall preventing the knitting yarn fed from the yarn feeding port from approaching a tongue top in a state where a hook of the compound needle is open. Therefore, when knitting a knitting stitch of a knitting end in the width direction of a knitted fabric, the problem of yarn entanglement of end stitches in which the knitting yarn is caught by the top of the tongue and goes outside the hook can be prevented, and the knitting yarn can be guided in the hook reliably.

According to the invention, the portion serving the knitting yarn holding function for end stitches has a recess on which a knitting yarn made of multiple yarns that is formed with a bundle of a plurality of fine yarns on the lower side. Therefore, even if a knitting yarn made of multiple yarns is used, the problem of yarn entanglement of end stitches in which a part of the knitting yarn is in contact with the tongue top in the state where the hook of the compound needle is open and goes outside the hook can be prevented reliably.

What is claimed is:

1. A loop presser in a flat knitting machine comprising at least a pair of needle beds including front and back needle beds, the pair of needle beds forming a tooth mouth, the front and back needle beds being opposed to each other and forming an angle such that top sides are oriented upward, and wherein compound needles are provided in each of the front and back needle beds as knitting needles, said loop presser having:

a top portion capable of advancing and retracting from an auxiliary bed supported on at least one of the front and back needle beds with respect to the tooth mouth in a process of making a knitting stitch loop from a knitting yarn fed from a yarn feeding port traveling in a longitudinal direction of the front and back needle beds above the tooth mouth to make a downwardly suspended knitted fabric, wherein said top portion has, at different positions in advancing and retracting directions of said loop presser, a loop presser portion operable to guide the knitting yarn fed from the yarn feeding port to one of the knitting needles and press the knitting stitch loop between the knitting needles on a lower side, and a knitting yarn holding portion for end stitches operable to hold knitting yarn fed from above the tooth mouth on the outside of a knitting end of a knitted fabric in a width direction;

wherein said knitting yarn holding portion has a pressing portion for pressing the knitting yarn suspended from the knitting stitch loop held by one of the compound needles in the knitting end to the yarn feeding port moving toward the outside of the knitted fabric on a lower side, and a wall portion preventing the knitting yarn fed from the yarn feeding port moving toward the inside of the knitted fabric by reversing the moving direction to the one of the compound needles in the knitting end from approaching a tongue top thereof having a hook open on an upper side thereof.

2. The loop presser of claim 1, wherein the knitting yarn holding portion is nearer to an end of said loop presser, with respect to the advancing and retracting direction, than said loop presser portion.

3. The loop presser of claim 1, wherein said knitting yarn holding portion has a recess on which a knitting yarn, made of multiple yarns that are formed with a bundle of a plurality of fine yarns, can converge on its lower side.

4. The loop presser of claim 2, wherein said knitting yarn holding portion has a recess on which a knitting yarn, made of multiple yarns that are formed with a bundle of a plurality of fine yarns, can converge on its lower side.

5. A flat knitting machine comprising:

the loop presser of claim 1;

a loop presser mechanism that advances to and retracts from the said portion according to a predetermined locus so as to guide the knitting yarn fed from the yarn feeding port passing through a position of the compound needle for making the knitted fabric to a position where the knitting yarn can be held by a hook of the compound needle and press a knitting stitch loop which is knitted by the pressing portion; and a knitting yarn holding mechanism for end stitches that holds the knitting yarn so as to advance the knitting yarn holding portion to the tooth mouth on the side before the compound needle used at first in knitting a knitted end, reversing a traveling direction of a yarn and starting knitting a next course, wherein after the yarn feeding port passes through the compound needle used at first in knitting, the loop presser mechanism and the knitting yarn holding mechanism cooperate so as to prevent the knitting yarn, fed to the compound needle used at first in knitting by guiding by the loop presser portion of the loop presser that is advanced to and retracted from by the loop presser mechanism, from approaching a tongue top in a state where a hook is open by a wall portion on an upper side of said knitting yarn holding portion of said loop presser that is advanced and retracted by the knitting yarn holding mechanism.

6. The flat knitting machine of claim 5, wherein:

the auxiliary bed, in which said loop presser advances and retracts, is open downward on a base end side of the advancing and retracting direction, said loop presser has a butt projected upward, and said flat knitting machine further comprises:

a selecting mechanism that is opposed to a base end portion of said loop presser below an open portion of the auxiliary bed and can selectively attract and release said base end portion; and a cam mechanism selectively functioning as said loop presser mechanism or said knitting yarn holding mechanism, said cam mechanism having a cam groove that is engaged with said butt above the auxiliary bed and drives said butt to be displaced in the advancing and retracting direction, wherein the cam mechanism can switch function either as said loop presser mechanism or said knitting yarn holding mechanism by selecting said cam groove engaged with said butt by releasing attraction to said base end portion of said loop presser with the selecting mechanism or not.

7. The flat knitting machine of claim 6, wherein said cam groove of said cam mechanism has a generally a symmetrical shape with respect to a central line parallel to the advancing and retracting direction of said loop presser so that said top portion of said loop presser draws the same locus when knitting on one side of the longitudinal direction of one of said needle beds as when knitting on the other side, and said selecting mechanism is positioned on one side and the other side of the needle bed in positions opposed to the central line of the cam mechanism and the same distance away from the central line.

8. A flat knitting machine comprising:

the loop presser of claim 2;

a loop presser mechanism that advances to and retracts from the said portion according to a predetermined locus so as to guide the knitting yarn fed from the yarn feeding port passing through a position of the compound needle for making the knitted fabric to a position where the knitting yarn can be held by a hook of the compound needle and press a knitting stitch loop which is knitted by the pressing portion; and a knitting yarn holding mechanism for end stitches that holds the knitting yarn so as to advance the knitting yarn holding portion to the tooth mouth on the side before the compound needle used at first in knitting a knitted end, reversing a traveling direction of a yarn and starting knitting a next course, wherein after the yarn feeding port passes through the compound needle used at first in knitting, the loop presser mechanism and the knitting yarn holding mechanism cooperate so as to prevent the knitting yarn, fed to the compound needle used at first in knitting by guiding by the loop presser portion of the loop presser that is advanced to and retracted from by the loop presser mechanism, from approaching a tongue top in a state where a hook is open by a wall portion on an upper side of said knitting yarn holding portion of said loop presser that is advanced and retracted by the knitting yarn holding mechanism.

9. The flat knitting machine of claim 8, wherein:

the auxiliary bed, in which said loop presser advances and retracts, is open downward on a base end side of the advancing and retracting direction, said loop presser has a butt projected upward, and said flat knitting machine further comprises:

a selecting mechanism that is opposed to a base end portion of said loop presser below an open portion of the auxiliary bed and can selectively attract and release said base end portion; and a cam mechanism selectively functioning as said loop presser mechanism or said knitting yarn holding mechanism, said cam mechanism having a cam groove that is engaged with said butt above the auxiliary bed and drives said butt to be displaced in the advancing and retracting direction, wherein the cam mechanism can switch function either as said loop presser mechanism or said knitting yarn holding mechanism by selecting said cam groove engaged with said butt by releasing attraction to said base end portion of said loop presser with the selecting mechanism or not.

10. The flat knitting machine of claim 9, wherein said cam groove of said cam mechanism has a generally a symmetrical shape with respect to a central line parallel to the advancing and retracting direction of said loop presser so that said top portion of said loop presser draws the same locus when knitting on one side of the longitudinal direction of one of said needle beds as when knitting on the other side, and said selecting mechanism is positioned on one side and the other side of the needle bed in positions opposed to the central line of the cam mechanism and the same distance away from the central line.

11. A flat knitting machine comprising:

the loop presser of claim 3;

a loop presser mechanism that advances to and retracts from the said portion according to a predetermined locus so as to guide the knitting yarn fed from the yarn feeding port passing through a position of the compound needle for making the knitted fabric to a position where the knitting yarn can be held by a hook of the compound needle and press a knitting stitch loop which is knitted by the pressing portion; and a knitting yarn holding mechanism for end stitches that holds the knitting yarn so as to advance the knitting yarn holding portion to the tooth mouth on the side before the compound needle used at first in knitting a knitted end, reversing a traveling direction of a yarn and starting knitting a next course, wherein after the yarn feeding port passes through the compound needle used at first in knitting, the loop presser mechanism and the knitting yarn holding mechanism cooperate so as to prevent the knitting yarn, fed to the compound needle used at first in knitting by guiding by the loop presser portion of the loop presser that is advanced to and retracted from by the loop presser mechanism, from approaching a tongue top in a state where a hook is open by a wall portion on an upper side of said knitting yarn holding portion of said loop presser that is advanced and retracted by the knitting yarn holding mechanism.

12. The flat knitting machine of claim 11, wherein:

the auxiliary bed, in which said loop presser advances and retracts, is open downward on a base end side of the advancing and retracting direction, said loop presser has a butt projected upward, and said flat knitting machine further comprises:

a selecting mechanism that is opposed to a base end portion of said loop presser below an open portion of the auxiliary bed and can selectively attract and release said base end portion; and a cam mechanism selectively functioning as said loop presser mechanism or said knitting yarn holding mechanism, said cam mechanism having a cam groove that is engaged with said butt above the auxiliary bed and drives said butt to be displaced in the advancing and retracting direction, wherein the cam mechanism can switch function either as said loop presser mechanism or said knitting yarn holding mechanism by selecting said cam groove engaged with said butt by releasing attraction to said base end portion of said loop presser with the selecting mechanism or not.

13. The flat knitting machine of claim 12, wherein said cam groove of said cam mechanism has a generally a symmetrical shape with respect to a central line parallel to the advancing and retracting direction of said loop presser so that said top portion of said loop presser draws the same locus when knitting on one side of the longitudinal direction of one of said needle beds as when knitting on the other side, and said selecting mechanism is positioned on one side and the other side of the needle bed in positions opposed to the central line of the cam mechanism and the same distance away from the central line.

14. A method for making a knitted fabric using a loop presser in a flat knitting machine comprising at least a pair of needle beds including front and back needle beds, the pair of needle beds forming a tooth mouth, the front and back needle beds being opposed to each other and forming an angle such that top sides are oriented upward, and wherein compound needles are provided in each of the front and back needle beds as knitting needles, said loop presser having a top portion capable of advancing and retracting from an auxiliary bed supported on at least one of the front and back needle beds with respect to the tooth mouth in a process of making a knitting stitch loop from a knitting yarn fed from a yarn feeding port traveling in a longitudinal direction of the front and back needle beds above the tooth mouth to make a downwardly suspended knitted fabric, said method comprising:

forming, in the top portion of the loop presser, at different positions in the advancing and retracting direction, a portion operable to guide the knitting yarn fed from the yarn feeding port to a position where the knitting yarn can be held by a hook of one of the compound needles and press the knitting stitch loop between the knitting needles on a lower side, and a portion operable to hold knitting yarn for end stitches fed from above the tooth mouth on the outside of a knitting end of the knitted fabric in a width direction thereof;

switching the loop presser between being operable to press the knitting stitch loop and being operable to hold the knitting yarn by switching a position to which the top portion of the loop presser is advanced to the tooth mouth;

making the knitting yarn hold so as to advance the portion operable to hold the knitting yarn in the top portion of the loop presser to the tooth mouth on the side before the compound needle used at first in knitting in knitting a knitted end, reversing a traveling direction of a yarn and starting knitting a next course, pressing the knitting yarn suspended from the compound needle in which the knitting end is knitted to the yarn feeding port on the lower side of the portion operable to hold knitting yarn until the yarn feeding port passes through a position of the compound needle, and feeding the knitting yarn to the compound needle used at first in knitting from the upper side of the portion operable to hold knitting yarn; and after the yarn feeding port passes through the compound needle used at first in knitting, making the loop presser cooperate so as to advance another loop presser to the tooth mouth and preventing the knitting yarn fed to the compound needle used at first in knitting by guiding with the portion serving the loop presser function from approaching a tongue top in a state where a hook is open with an upper side of the loop presser that advances the portion operable to hold knitting yarn to the tooth mouth serving as a wall.

15. The method of claim 14, wherein the portion operable to hold knitting yarn has a recess on the lower side in a state where the portion operable to press the knitting stitch loop advances to the tooth mouth, and knitting is performed while converging a knitting yarn made of multiple yarns that are formed with a bundle of a plurality of fine yarns on the recess.

* * * * *

UNITED STATES PATENT AND TRADEMARK OFFICE

CERTIFICATE OF CORRECTION

PATENT NO. : 6,883,352 B2
DATED : April 26, 2005
INVENTOR(S) : Takuya Miyai

It is certified that error appears in the above-identified patent and that said Letters Patent is hereby corrected as shown below:

Title page,
Item [54], Title, please change "LOOP PRESSER, FLATBED KNITTING MACHINE HAVING LOOP PRESSER, AND FABRIC KNITTING METHOD USING LOOP PRESSER" to -- LOOP PRESSER, FLAT KNITTING MACHINE PROVIDED WITH LOOP PRESSER, AND METHOD FOR MAKING A KNITTED FABRIC USING LOOP PRESSER --.

Signed and Sealed this

Twenty-third Day of August, 2005

JON W. DUDAS
*Director of the United States Patent and Trademark Office*